US005164648A

United States Patent [19]

Kita et al.

[11] Patent Number: 5,164,648

[45] Date of Patent: Nov. 17, 1992

[54] EQUIPMENT FOR TRANSPORTING A LOAD

[75] Inventors: Hiroaki Kita; Koichi Murata, both of Kasugai; Mamoru Nakano, Komaki, all of Japan

[73] Assignee: Daifuku Co., Ltd., Japan

[21] Appl. No.: 775,511

[22] Filed: Oct. 15, 1991

Related U.S. Application Data

[62] Division of Ser. No. 720,637, Jun. 25, 1991, Pat. No. 5,134,353.

[30] Foreign Application Priority Data

Jul. 19, 1990 [JP] Japan ..... 2-183472
Jul. 19, 1990 [JP] Japan ..... 2-192500

[51] Int. Cl.[5] ..... G05D 1/08

[52] U.S. Cl. ..... 318/587; 318/586; 180/167; 180/169; 364/424.02

[58] Field of Search ..... 318/135, 138, 139, 560–589, 318/632, 625, 636, 640; 180/167–169; 367/99, 96, 909; 364/424.01, 424.02, 464, 443; 901/1, 3, 5, 9, 12, 13

[56] References Cited

U.S. PATENT DOCUMENTS 3,474,444 10/1969 Okamoto .
3,689,882 9/1972 Dessailly ..... 180/167
3,749,197 7/1973 Deutsch ..... 180/167
3,892,483 7/1975 Saufferer ..... 180/167 X
3,898,652 8/1975 Rashid ..... 180/167 X
4,473,787 9/1984 Schick ..... 318/587
4,706,086 11/1987 Panizza ..... 180/167 X
4,783,618 11/1988 Artrip ..... 318/587
4,920,520 4/1990 Gobel et al. ..... 367/99
4,926,170 5/1990 Beggs et al. ..... 180/169 X
4,958,068 9/1990 Pong et al. ..... 180/167 X
5,036,935 8/1991 Kohara ..... 318/587 X
5,068,790 11/1991 Wellman ..... 318/587 X
5,068,791 11/1991 Klopfleisch et al. ..... 364/424.02

*Primary Examiner*—Paul Ip
*Attorney, Agent, or Firm*—Barnes, Kisselle, Raisch, Choate, Whittemore & Hulbert

[57] ABSTRACT

A load transport equipment having self-propelled trucks travelling on a predetermined route so as to transport a load by the truck, wherein an encoder is connected to a motor and the pulse number from the encoder is counted by a counter, the counted value being optically transmitted toward another self-propelled truck following the front self-propelled truck on the predetermined route, the following self-propelled truck receiving the counted value from the front self-propelled truck to obtain a difference between the received counted value and that of the following truck, so that the travel speed of the rear self-propelled truck is controlled on the basis of the difference so that the running speed is controlled in accordance with the distance between the trucks thereby preventing a rear-end collision.

1 Claim, 22 Drawing Sheets

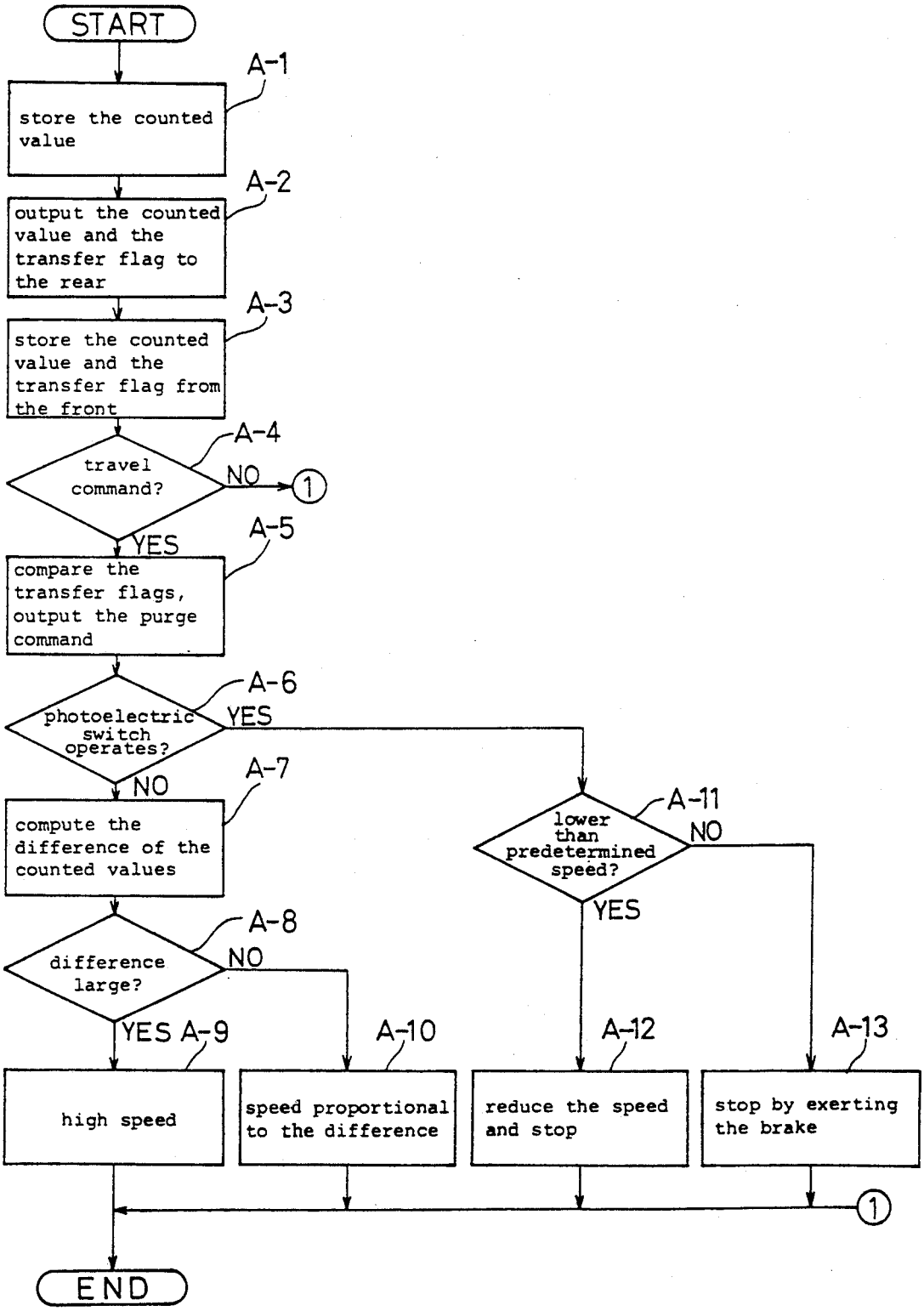
START
A-1
store the counted value
A-2
output the counted value and the transfer flag to the rear
A-3
store the counted value and the transfer flag from the front
A-4
travel command?
NO
1
YES
A-5
compare the transfer flags, output the purge command
A-6
photoelectric switch operates?
YES
NO
A-7
compute the difference of the counted values
A-8
difference large?
NO
YES
A-9
high speed
A-10
speed proportional to the difference
A-11
lower than predetermined speed?
NO
YES
A-12
reduce the speed and stop
A-13
stop by exerting the brake
1
END

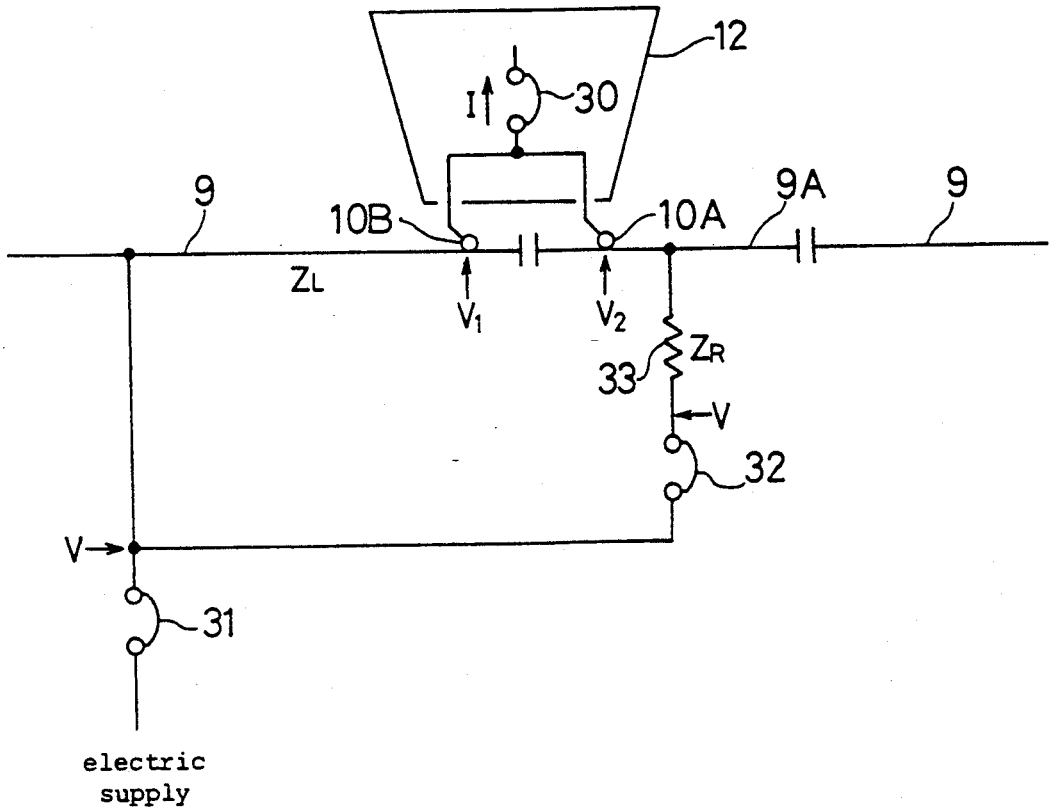
12
I
30
9
10B
10A
9A
9
ZL
V1
V2
ZR
33
V
32
V
31
electric
supply

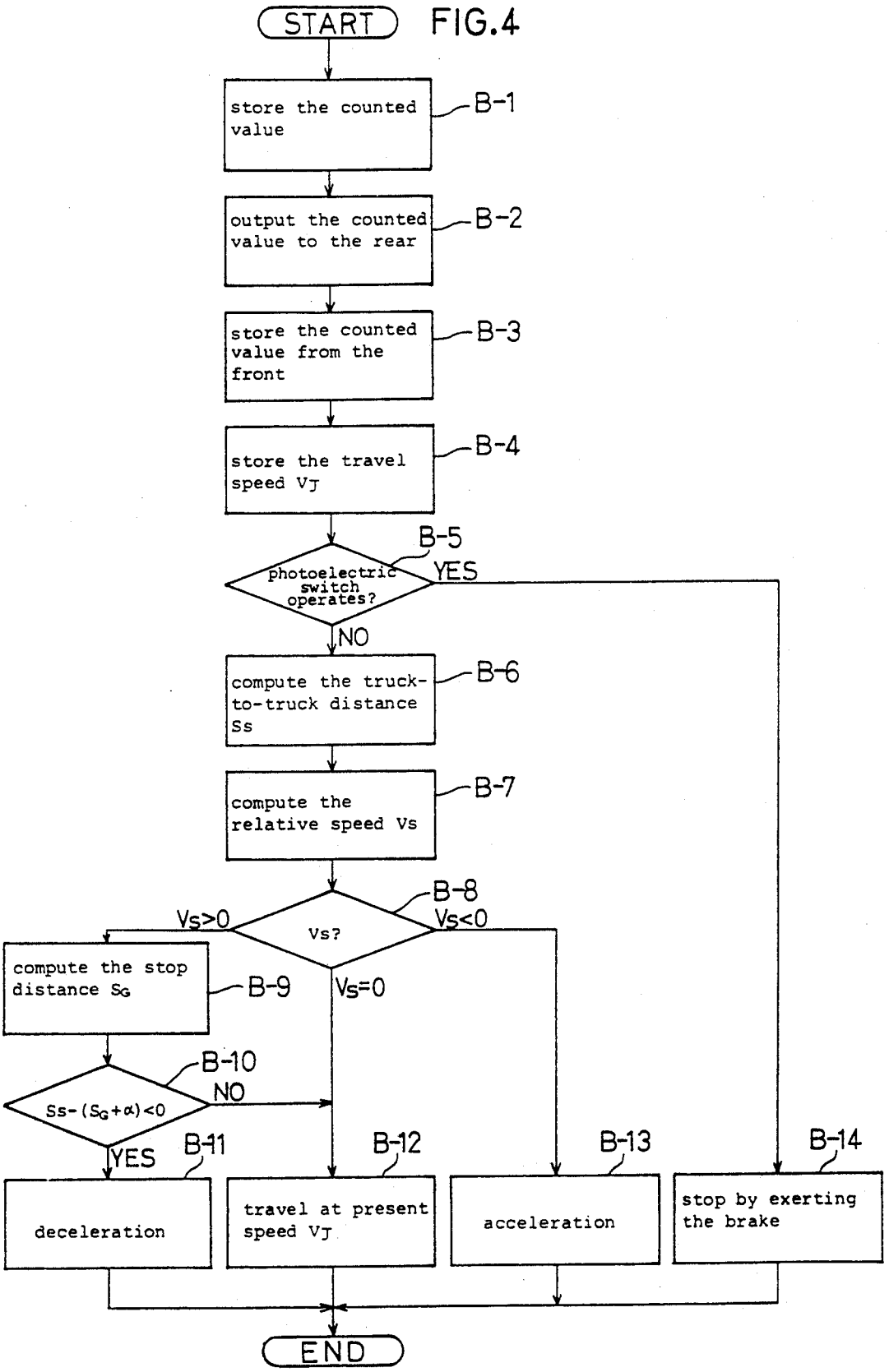
START
FIG.4
store the counted value
B-1
output the counted value to the rear
B-2
store the counted value from the front
B-3
store the travel speed VJ
B-4
B-5
photoelectric switch operates?
YES
NO
compute the truck-to-truck distance Ss
B-6
compute the relative speed Vs
B-7
B-8
Vs?
Vs>0
Vs<0
Vs=0
compute the stop distance SG
B-9
B-10
Ss-(SG+α)<0
NO
YES
B-11
B-12
B-13
B-14
deceleration
travel at present speed VJ
acceleration
stop by exerting the brake
END —·— front self-propelled truck —— this self-propelled truck —··— conventional self-propelled truck START
C-1
travel command?
NO
1
YES
C-2
photoelectric switch on?
YES
NO
C-3
photosensor receiver on ?
NO
YES
C-6
lower than the low speed?
NO
YES
C-8
lower than the set speed?
NO
YES
C-10
output an alarm
C-5
low speed
C-4
high speed
C-7
stop by deceleration
C-9
stop by exerting the brake
1
END START
E-1
detect a curve portion ?
NO
1
YES
compute the present travel speed Va
E-2
compute the deceleration distance S
E-3
compute the travel distance Xa
E-4
compute the time Ta
E-5
Ta≥0?
E-6
NO
E-7
exert the brake
YES
E-8
count the time Ta
deceleration
E-9
Va=Vb?
E-10
NO
YES
1
END

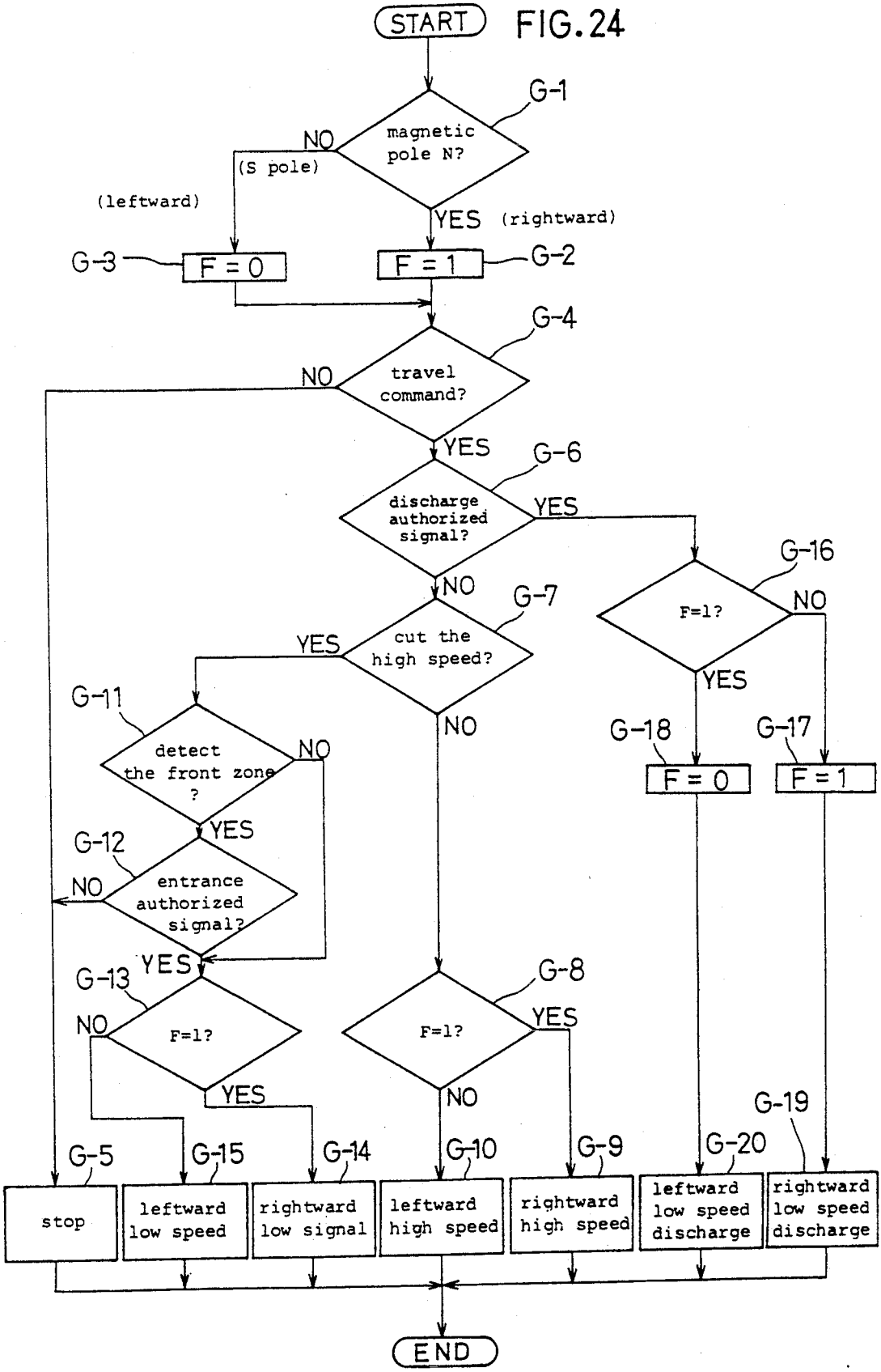
START
FIG. 24
G-1
magnetic pole N?
NO
(S pole)
(leftward)
YES
(rightward)
G-3
F = 0
F = 1
G-2
G-4
travel command?
NO
YES
G-6
discharge authorized signal?
YES
NO
G-7
cut the high speed?
YES
NO
G-16
F=1?
NO
YES
G-11
detect the front zone ?
NO
YES
G-12
entrance authorized signal?
NO
YES
G-13
F=1?
NO
YES
G-8
F=1?
YES
NO
G-18
F = 0
G-17
F = 1
G-5
stop
G-15
leftward low speed
G-14
rightward low signal
G-10
leftward high speed
G-9
rightward high speed
G-20
leftward low speed discharge
G-19
rightward low speed discharge
END

EQUIPMENT FOR TRANSPORTING A LOAD

This is a continuation of copending application(s) Ser. No. 07/720,637 filed on Jun. 25, 1991, now U.S. Pat. No. 5,134,353.

FIELD OF THE INVENTION

The present invention relates to equipment for transporting a load, which equipment includes a plurality of self-propelled trucks. Each self-propelled truck is provided with a travelling motor fed from a feeder rail (trolley) laid along a predetermined route and driven by the motor so as to travel on the predetermined route for transporting the load.

BACKGROUND OF THE INVENTION

In well-known load transport equipment, each self-propelled truck is usually controlled for preventing a rear-end collision so that trucks do not collide with each other.

Therefore, in the well-known load transporting equipment, a photoelectric switch is provided at the front of each self-propelled truck travelling along a travel rail, the photoelectric switch being used to set a first detection region in front of the self-propelled truck, thereby enabling the existence of other self-propelled trucks in the detection region to be detected. Also, the front of each self-propelled truck is provided with a photosensor receiver for detecting the light emitted from the front, and the rear of the truck is provided with a photosensor transmitter which projects the light toward a second detection region extending farther from the first detection region set by the photoelectric switch and expanding wider than the first detection region.

When the photosensor receiver of a running rear truck receives the light from the photosensor transmitter of another self-propelled truck in front, the speed of the rear truck is reduced from high to low. Also, when the photoelectric switch of a rear truck detects another self-propelled truck in front, the rear truck stops, thereby preventing a rear-end collision between both the trucks.

However, for the well-known load transporting equipment, the photosensor transmitter must spread the light to be transmitted so as to enable the light to be received even at a curved portion of the travelling rail. However, it has been impossible to project the light in the distance sufficiently to permit a reduction in speed in time to prevent a rear-end collision with the truck in front.

SUMMARY OF THE INVENTION

An object of the present invention is to provide load transport equipment which solves the above problem to make the speed of a truck adjustable from an early enough time to avoid a rear-end collision.

In order to attain the object, the load transporting equipment of the invention is provided with a plurality of self-propelled trucks which are self-propelled to transport loads along a predetermined route. The self-propelled trucks each have means for detecting a distance between said self-propelled truck and said base point, means for transmitting-receiving the distance data between said self-propelled truck and another self-propelled truck behind and/or in front of said truck, means for transmitting from said transmitting-receiving means the distance data detected by said detecting means, receiving by said transmitting and receiving means the distance data of said front self-propelled truck transmitted therefrom and obtaining a difference between said distance data of said rear self-propelled truck and front self-propelled truck, thereby controlling the speed of the rear self-propelled truck corresponding to said difference.

Such construction transmits through the transmitting-receiving means the distance data detected by the detecting means, obtains a difference between the distance data and that of the front self-propelled truck input from the transmitting-receiving means, and controls the truck speed corresponding to the difference, so that the running speed is controlled in accordance with the distance between both trucks to merely prevent a rear-end collision.

The above and further objects and novel features of the invention will more fully appear from the following detailed description when the same is read in connection with the accompanying drawings.

BRIEF DESCRIPTION OF THE DRAWINGS

FIG. 2 is a flow chart of the control of travel of the self-propelled truck in FIG. 1, FIG. 3 shows another example of a feeder rail for the load transport equipment in FIG. 1, FIG. 4 is a flow chart of the control of travel of the self-propelled truck in a second embodiment, FIG. 24 is a flow chart of the travel control of the self-propelled truck in the load transport equipment shown in FIGS. 21 to 23.

DETAILED DESCRIPTION OF THE EMBODIMENTS

Figure 1:
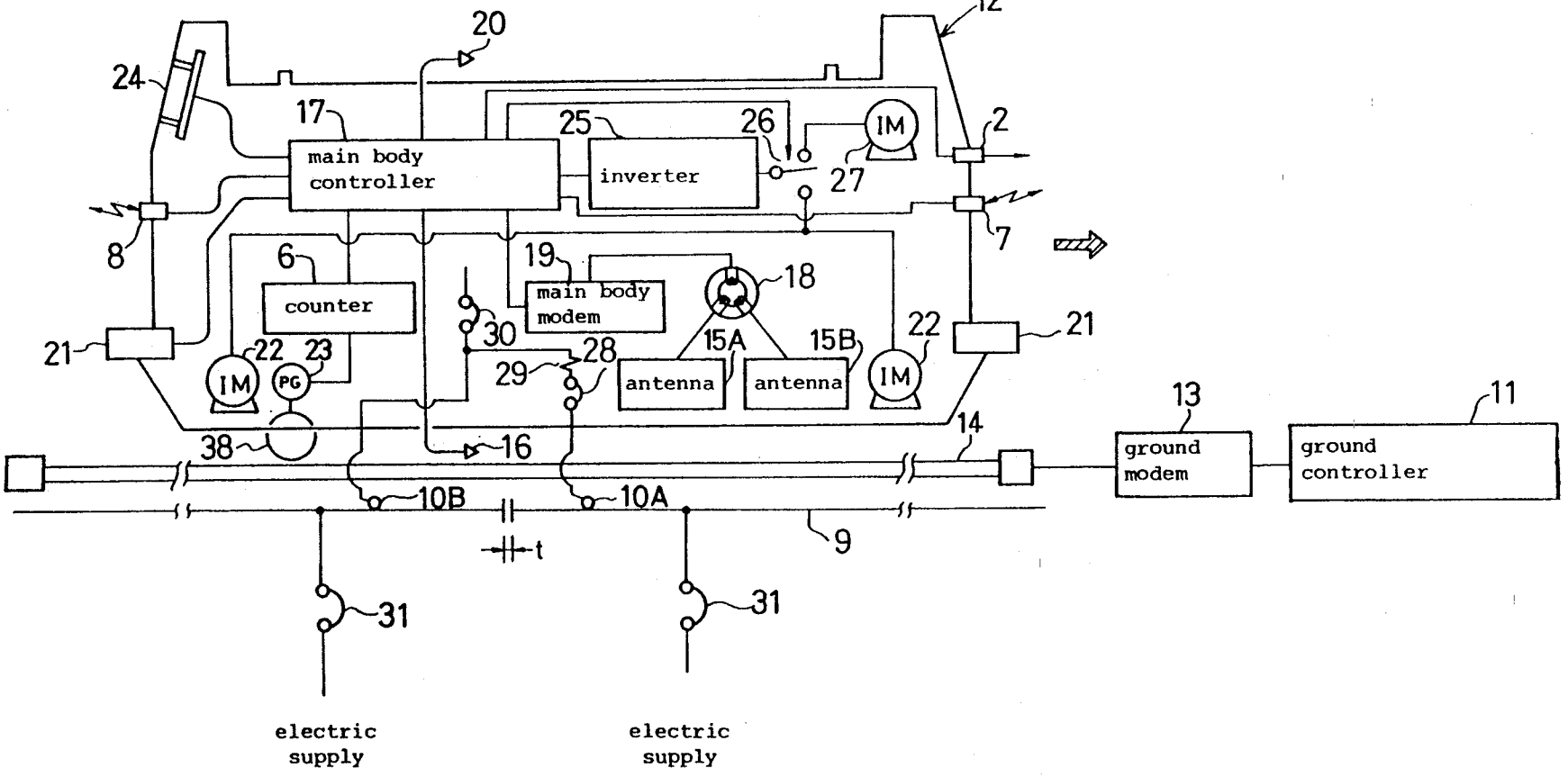
FIG. 1 is a block diagram of a self-propelled truck in a first embodiment of the load transporting equipment of the invention.

In FIG. 1, reference numeral 11 designates ground controllers comprising microcomputers and disposed apart from each other and along a travel rail on which self-propelled trucks travel in order to provide multiple-unit-control for a plurality of self-propelled trucks 12. The ground controller 11 is given a load transfer signal from a station for transferring the load or a host computer in high order (both are not shown) and is also given a feedback signal, for example, an address signal indicative of the present position or the existence of load, of every self-propelled truck 12 from a ground modem 13, and output to each self-propelled truck 12 an instruction of destination thereof or of whether or not the load is to be transferred. The ground controller 11 also transmits the signal to the self-propelled truck 12 through the ground modem 13 corresponding to a transmitter-receiver and a feeder wire laid along the travel rail throughout the entire length of travel of the self-propelled truck 12.

The self-propelled truck 12 is provided with two antennas 15A and 15B spaced apart in the running direction of the truck 12 and adjacent and close to the feeder wire 14. A main body controller 17 transmits the signal to the ground controller 11 through the two antennas 15A and 15B, a distributor 18, and a main body modem 19 corresponding to the transmitter-receiver. Also, the self-propelled truck 12 is provided with a transfer portion detector 20 comprising a photoelectric switch for detecting as a sensor the existence of load and whether or not the load is in the predetermined position, a base point detector 16 comprising a photoelectric switch disposed on the running rail for detecting the base point, a bumper switch 21 for detecting a rear-end collision, and an encoder 23 engaged with the shaft of a wheel 38 which rotates in contact with the travel rail for detecting the travel distance and travel speed by the number of rotations of the wheel 38. The self-propelled truck 12 is provided with a photoelectric switch 2 for detecting another truck travelling ahead of truck 12, first and second optical data transmitter-receivers 7 and 8 at the front and rear of the self-propelled truck 12, and a counter 6 which counts the pulse number of encoder 23 and is reset by a detection signal of the base point detection means 16.

The main body controller 17 operates on the basis of detection signals from the respective sensors 16, 20 and 21, a counted value from the counter 6, a control signal issued from the ground controller 11 and input to the main body modem 19, control signals issued from the front and rear self-propelled trucks 12 and input to the first and second optical data transmitter-receivers 7 and 8, and a control signal from a control box (not shown) connected to a control panel 24. Also, the main body controller 17 controls a travelling motor 22 or a transfer motor 27 through an inverter 25 or by switching a change-over switch 26, thereby controlling the self-propelling of the truck 12 and transfer of load therefrom. In order to feed electricity to a control power source (not shown), such as the inverter 25 or the main body controller 17, two current controllers 10A and 10B for current-collecting from a feeder rail 9 laid along the travelling rail are provided. The two current-collectors 10A and 10B, as shown in FIG. 1, are spaced at an interval to feed the self-propelled truck 12 and the feeder rails divided corresponding to the number of trucks 12 are spaced at a predetermined interval more than t. The current-collector 10A at the front of truck 12 in the forward running direction feeds the self-propelled truck 12 sequentially through a first circuit breaker (to be hereinafter abbreviated to NFB) 28 having a trip coil and connected in series, a resistance 29 and a second NFB 30. The collector 10B at the rear in the running direction feeds the self-propelled truck 12 through a second NFB 30. In FIG. 1, reference numeral 31 designates NFBs interposed in feeder routes toward the divided feeder rails.

By such feeding method, when the self-propelled truck 12 transfers from one feeder rail to the other, a current flowing between both the feeder rails 9 is limited by the resistance 29 in the truck 12. Hence, arcing is prevented from being generated between the feeder rail 9 and the collectors 10A and 10B, NFB 31 to feed the laid feeder rail 9 is prevented from tripping, and the self-propelled truck 12 is prevented from stopping. Also, in the worst case, even when the arcing causes an over current, the first NFB 28 operates to break the circuit so as to prevent in the truck 12 the effect of arcing from spreading and the resistance 29 from being burnt. The first NFB 28 operates to actuate the second NFB 30, thereby preventing instruments in the self-propelled truck 12 from being damaged by the over current.

Next, explanation will be given on travel control by the main body controller 17 in accordance with the flow chart in FIG. 2.

At first, the counted value input from the counter 6 is stored (in a step (A-1)), and data comprising the counted value and a load transfer flag (flag set when the load is put on by transfer control) is output to the rear truck 12 through the second optical data transmitter-receiver 8 (in a step (A-2)).

Next, data the same as the above-mentioned data is input from the front truck 12 through the first optical data transmitter-receiver 7 and is stored (in a step (A-3)), and the counted value from the proportional base point transmitted from the ground controller 11 is compared with the self-counted value, thereby determining whether or not a running command is transmitted (in a step (A-4)).

In the step (A-4), in a case of receiving the travel command, the transfer flag in the data of front truck 12 is compared with the self-transfer flag. When the front self-propelled truck 12 is not transferred (loaded) of load and the rear truck 12 transfers (or loads) the load, a purge command is output to the front truck 12 through the first optical data transmitter-receiver 7 (in a step (A-5)). Next, it is decided whether the photoelectric switch 2 operates (in a step (A-6)), so that when not operating, a difference between the counted value input from the front truck 12 and that of the rear truck is taken (in a step (A-7)). The difference is compared with a predetermined value (in a step (A-8)). When the difference is larger than the predetermined value, that indicates that the truck 12 is remote from the front truck 12, and accordingly the truck 12 is driven at high speed (in a step (A-9)). When the difference is smaller than the predetermined value that is, the truck 12 is close to the front truck 12, the speed is reduced from high speed to low speed (in a step (A-10)).

In the step (A-6), when the photoelectric switch 2 operates, it is determined by an increase in the counted value input from the counter 6 whether or not the travel speed of truck 12 computed from the detected number of rotations of travelling moter 22 is lower than the predetermined speed (in a step (A-11)). When lower than that, the brake is not exerted to stop the truck at the predetermined reduced speed (in a step (A-12)), and when the travel speed exceeds the predetermined speed, the brake of the travel motor 22 is exerted to stop the truck 12 (in a step (A-13)). The self-propelled truck 12, when given the purge command from the other rear truck 12 through the second optical data transmitter-receiver 8, temporarily evacuates to the nearest branch (not shown) from the travelling rail. Such temporary evacuation is carried out in such a manner that, for example, a tape mounted in a predetermined length to the travel rail so as to indicate the branch, is detected by the base point detector 16 so that the truck 12 confirms the branch position to stop and is temporarily moved from the travel rail through evacuation means.

Thus, the first and second optical data transmitter-receivers 7 and 8 are used to check a distance between the front and rear trucks 12 and control the travel speed of the rear one, thereby enabling the distance therebetween to be always constant, thus preventing a rear-end collision. At a place where the travel rail 5 curves, it is impossible to transmit or receive the signal by use of first and second optical data transmitter-receivers 7 and 8, but the travel speed determined by the previous control routine is held or the travel speed is reduced from the present speed. Also, as above-mentioned, it is possible to use the first and second optical data transmitter-receivers 7 and 8 to purge the front truck 12 so that the rear one can travel ahead thereof, thereby improving the transportation efficiency.

In the above described embodiment, the optical data transmitter-receivers 7 and 8 are used as a means for transmitting and receiving the data and control signal between the self-travelling trucks 12. However, it is alternatively possible to transmit the data and control signal from the main body controller 17 to the ground controller 11 through the antennas 15A and 15B and the feeder wire 14.

Further, though the encoder 23 detects the rotation number of the wheel 38 in the above described embodiment, it is possible to detect the rotation number of the running motor 22 or the driving wheel of the truck 12. The wheel 38, the encoder 23, the base point detector 16 and the counter 6 are disposed as a means for detecting the travel distance in the above described embodiment, however it is possible to compute the travel distance by integrating the driving speed along the driving time, the integration value being reset by the detection signal of the base point detector 16.

The self-propelled truck 12 is provided with current-collectors 10A and 10B, first NFB 28, resistance 29 and second NFB 30, whereby when the truck 12 transfers to the separate feeder rail 9, arcing can be prevented from being generated between the feeder rail 9 and the collector 10, thereby improving the reliability when the truck 12 is driven. Furthermore, in the worst case, even when an over current is generated by the arcing, the influence of arcing can be prevented from spreading within the truck, and the resistance 29 is prevented from burning. Also, the first NFB 28 operates to actuate the second NFB 30, and the influence of arcing can be prevented from spreading to apparatus in the self-propelled truck 12.

In addition, in this embodiment, the self-propelled truck 12 is provided with the collectors 10A and 10B, first NFB 28, resistance 29 and second NFB 30, but alternatively, as shown in FIG. 3, only current collectors 10A and 10B and second NFB 30 may be provided in the truck 12 in consideration of the number thereof, the feeder rail 9 may be divided corresponding to the number of feedable trucks 12, and a second feeder rail 9A long enough to support one truck 12 may be laid between the respective feeder rails 9. In this case, each feeder rail 9 is current-supplied through the NFB 31, the second feeder rail 9A sequentially through an NFB 32, a second NFB 32 and a resistance 33.

The resistance 33 is selected as follows:

When voltage of first and second NFBs 31 and 32 at the feeder rails 9 and 9A sides is represented by V, voltages at the borders between the feeder rails 9 and that 9A by $V_1$ and $V_2$, the number of self-propelled trucks 12 within the feeder rails 9 by n, a current value supplied to one truck 12 by I, impedance of feeder rail 9 by $Z_L$, and impedance of resistance 33 by $Z_R$, the following expressions are obtained:

$$V_2 = V - 3 \cdot I \cdot Z_R$$

When the self-propelled truck 12 transfers from the first feeder rail 9 to the second feeder rail 9A, in order to prevent generation of arc between the feeder rail and the collector, the requirement is $V_1 = V_2$, whereby the following expression need only be selected:

$$Z_R = n \cdot Z_L$$

According to such feeding system, the potential difference at the border between the feeder rail 9 and the second feeder rail 9A is lost by a voltage drop at the resistance 33. Therefore, when the truck 12 transfers from the first feeder rail 9 to the second feeder rail 9A, arcing is prevented from being generated between the feeder rail and the collector. Even in the worst case, the second NFB 32 is tripped and continuously the NFB 32 is tripped, whereby the influence of arcing can be restricted only to the first feeder rail 9 and second feeder rail 9A. Since the NFB 28 and resistance 29 are not required, the manufacturing cost of the self-propelled truck 12 can be lowered.

Figure 5:
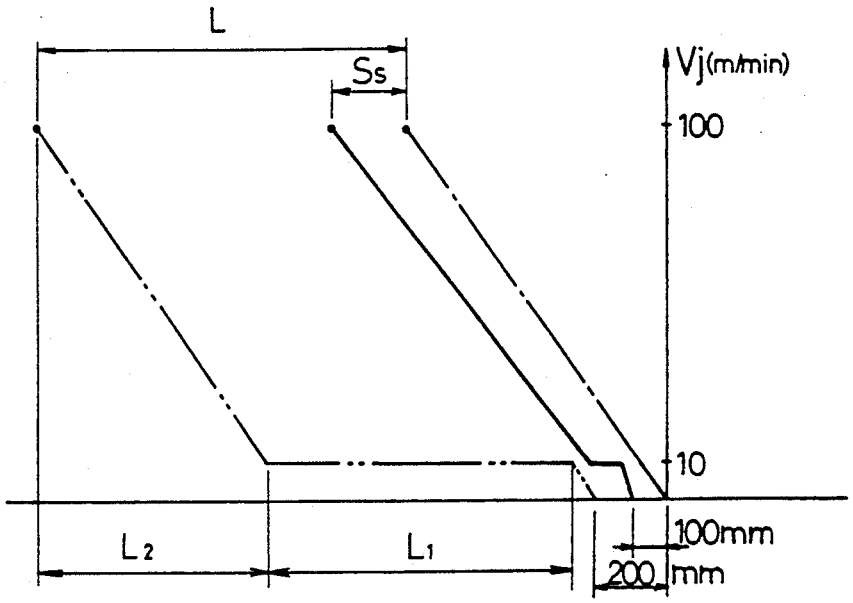
FIG. 5 shows travel characteristic of the self-propelled truck with travel control in accordance with FIG. 4.

FIGS. 4 and 5 are views explanatory of the second embodiment of the invention.

Now, it is assumed that the self-propelled truck 12 is travelling by receiving the running command from a ground controller.

In FIG. 4, at first, a counted value input from the counter 6 is stored (in a step B-1), the counted value is output to the rear self-propelled truck 12 through an optical data (in a step 8-2), and next, the counted value of the front self-propelled truck input therefrom is stored (in a step B-3).

The self-travel speed $V_J$ is computed by the following equation (1) (in a step B-4). When the counted value of the present self-propelled truck 12 is represented by $Y_1$, that of this self-propelled truck 12 before T second by $Y_2$, and a value of converting the counted value in milimeter unit by K, the following equation is obtained:

$$V_J=(Y_1-Y_2)\times K/T \quad (1)$$

Next, it is decided whether or not the photoelectric switch 2 operates (in a step B-5). When not operated, at first the counted value input from the front self-propelled truck 12 and that of the rear truck 12 are used to compute a distance $S_s$ between both the self-propelled trucks 12 by means of the following equation (2) (in a step B-6).

When the counted value of the present front truck 12 is represented by $X_1$, and an entire length of truck 12 by L, the following equation is obtained:

$$S_s=(X_1-Y_2)\times A-L \quad (2)$$

Relative speed $V_s$ between both the self-propelled trucks 12 is computed by the following equation (3) (in a step B-7).

When the counted value of the front self-propelled truck 12 before T second is represented by $X_2$, the following equation is obtained:

$$V_s=\{(Y_1-Y_2)-(X_1-X_2)\}\times K/T \quad (3)$$

The relative speed $V_s$ is confirmed as to whether it is larger or smaller than zero (in a step B-8). When the relative speed $V_s$ is larger than zero, in other words, when the travel speed $V_J$ of the rear truck 12 is faster than that of the front truck 12, a stop distance $S_G$ at the relative speed $V_s$ is computed by the following equation (4) (in a step B-9). When acceleration and deceleration (those of all the trucks are equal) of truck 12 is represented by G, $$S_G=V_s^2/(2G) \quad (4)$$

is obtained.

A value of stopping distance $S_G$ added with an allowance $\alpha$, that is, $(S_G+\alpha)$ is confirmed as to whether it exceeds the distance $S_s$ between the trucks (in a step B-10). When larger, in other words, when there is a danger of rear-end collision with the front truck 12, the speed is reduced at the deceleration G (in a step B-11), the allowance $\alpha$ corresponding to a time difference until the speed reduction starts and being represented by a function of travel speed $V_J$.

In the step B-8, when the relative speed $V_s$ is confirmed to be zero, or in the step B-10, when $(S_G+\alpha)$ is equal to or smaller than the distance $S_s$ between the trucks, the present travel speed $V_J$ is maintained to drive the truck 12 (in a step B-12). On the contrary, in the step B-8, when the relative speed $V_s$ is smaller than zero, that is, the travel speed $V_J$ of rear truck 12 is lower than that of front truck 12, the speed is increased by acceleration G (in a step B-13).

By executing above described control, the influence of the temperature and the like to the conventional optical receiver can be eliminated, thereby enabling the distance $S_s$ between trucks to be a suitable value. When the rear truck 12 has the same speed as the front truck, the distance $S_s$ is obtained by the following equation:

$$S_s=V_J\times(\text{response delay time})+\alpha$$

For example, while the rear truck 12 is travelling at the following conditions, self-travel speed $V_J$ = 100 m/min
acceleration and deceleration speed $G$ = 0.05 g
allowance $\alpha$ = 200 mm.

when the front truck 12 operates to stop with a created time difference of 0.2 sec of stop operation, distance $$\begin{aligned} S_s &= 100\text{ m/min}\times 0.2\text{ sec}+200\text{ mm} \\ &= 533\text{ mm} \end{aligned}$$

is obtained.

On the other hand, in case of the conventional self-propelled truck, of which characteristic is also shown in FIG. 5, the distance between the trucks corresponds to the stop distance when the rear truck is travelling at a high speed (100 m/sec). As shoen in FIG. 5, when the travel distance under the deceleration G is represented by $L_2$, and the travel distance under the intermediate speed (10 m/min) is represented by $L_1$, the following equations are obtained:

$$L=L_1+L_2+V_J\times(\text{response delay time})+\alpha$$

$L_1=0.6\,L_2$ ($L_1$ is necessary according to the temperature characteristic of the conventional optical receiver, that is −1.5%/°C., and changes by 60% when used in the temperature range of 0° to 40° C.)

$L_2=V_J^2/(2G)$.

Accordingly, distance L is calculated under same condition, thereby $$\begin{aligned} L &= (100\text{ m/min})^2/(2\times 0.05\text{ g})\times 1.6 \\ &\quad +100\text{ m/min}\times 0.2\text{ sec} \\ &\quad +200\text{ mm} \\ &= 5069\text{ mm} \end{aligned}$$

is obtained.

Thus, according to the invention, the distance between the trucks can be reduced comparing with the conventional equipment, thereby increasing the number of the truck 12 fed into one transporting line and improving the transportation capacity.

According to the conventional equipment, when the travelling speed is reduced to the intermediate speed (10 m/min), the truck keeps this speed and stops at the distance corresponds to the detecting distance (for example, 200 mm) of a photoelectric switch which detects the front truck. However, according to the invention, the truck 12 can travel, at the intermediate speed (10 m/min), 100 mm (allowance when travelling: 200 mm−distance between trucks when stopped: 100 mm), reduce the speed thereof and stop.

As shown in FIG. 5, when both rear and front trucks are travelling at a high speed (100 m/min), the decelerating distance R of the front truck is obtained as follows:

$$R = V_J^2/(2G)$$
$$= (100\ \text{m/min})^2/(2 \times 0.05\ \text{g})$$
$$= 2835\ \text{mm}.$$

When $S_s = 533$ mm, the decelerating distance from the speed of 10 m/min, that is $V_J^2/(2G)$, is to be 28 mm. The distance $S_B$ between trucks at the speed of 10 m/min is obtained as follows:

$$S_B = 10\ \text{m/min} \times 0.2\ \text{sec} + 200\ \text{mm}$$
$$= 233\ \text{mm}.$$

Thus, the decelerating distance W of the truck 12 before the speed is decelerated to 10 m/min is obtained as follows:

$$W = 2835 - 28 + (533 - 233)$$
$$= 3107\ \text{mm}.$$

The average deceleration G at the condition is obtained as follows:

$$G = (100\ \text{m/min})^2/(2 \times 3107\ \text{mm})$$
$$= 447\ \text{mm/sec}^2.$$

A time T until the truck stops after the start of the deceleration is obtained as follows:

$$T = (2S/G)^{1/2}$$
$$= [2 \times 3107\ \text{mm}/(447\ \text{mm/sec}^2)]^{1/2}$$
$$+ [2 \times 28\ \text{mm}/(0.05\ \text{g})]^{1/2}$$
$$+ 100\ \text{mm}/(100\ \text{m/min})$$
$$= 4.67\ \text{sec}.$$

On the other hand, a time T' until the truck stops according to the conventional equipment is obtained as follows:

$$T = [2 \times 2835\ \text{mm}/(0.05\ \text{g})]^{1/2}$$
$$+ (5069 - 2835 - 200\ \text{mm})/(10\ \text{m/min})$$
$$= 15.58\ \text{sec}.$$

It is understood by comparing T with T' that the truck 12 according to the invention can rapidly stop and quickly respond to the commands from the following ground controller 11.

Thus, the distance $S_s$ between the front and rear trucks 12, relative speed $V_s$, and stop distance $S_G$ thereat, are computed and confirmed to control the travel speed, thereby enabling the distance between both the trucks to be always constant corresponding to the speed of the front truck 12. Therefore, the rear-end collision of the front truck with the rear one can be prevented, a stop time can be reduced, and the distance between the trucks can be reduced, thereby enabling the transportation capacity and efficiency to be improved.

In the above-mentioned embodiment, the counted value input from the counter 6 is stored and then output to the rear truck 12 through an optical data transmitter 8. In this case, the travel speed $V_J$ computed by the equation (1) may be output to the rear self-propelled truck 12, at which time the relative speed $V_s$ in the equation (3), when the travel speed of the front truck 12 is represented by $V_x$, is given in $$V_s = V_J - V_x \qquad (3')$$

Therefore, it is not required to store the counted value and the speed of the front self-propelled truck 12, thereby reducing capacity of a memory at the main body controller 17.

Figure 6:
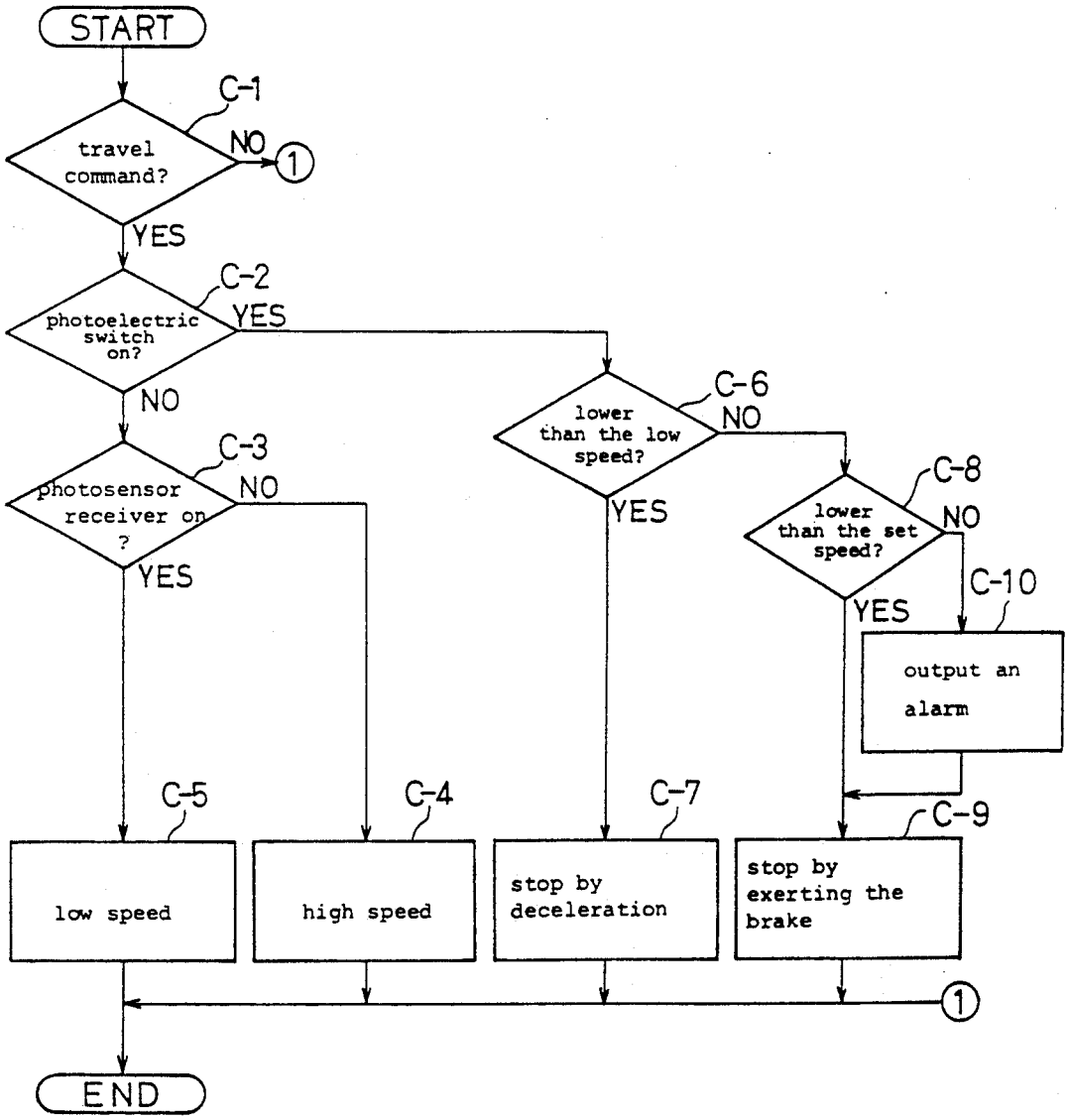
FIG. 6 is a flow chart of travel control of the self-propelled truck in a third embodiment of the invention.
Figure 7:
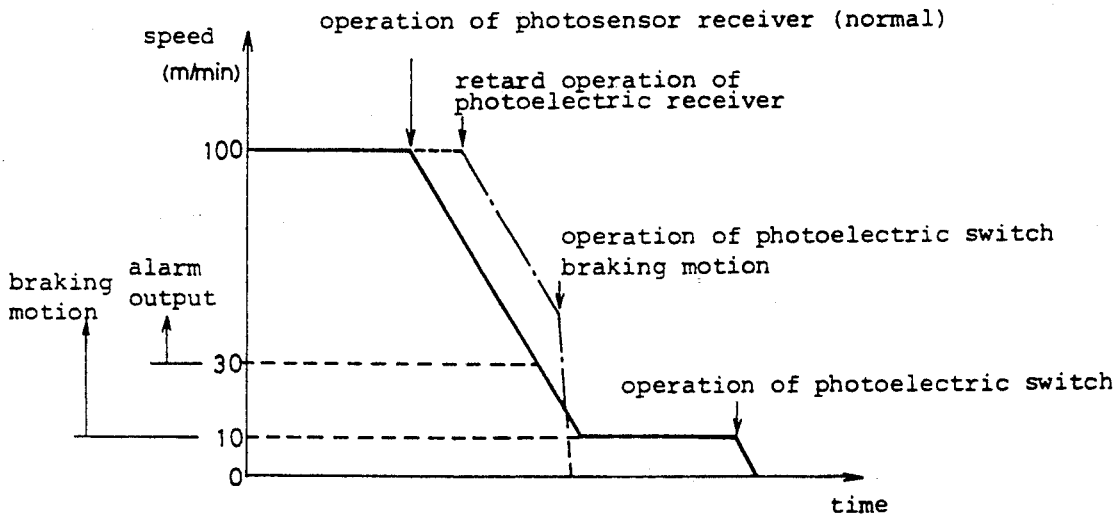
FIG. 7 shows the travel characteristic of the self-propelled truck with travel control in accordance with FIG. 6.
Figure 8:
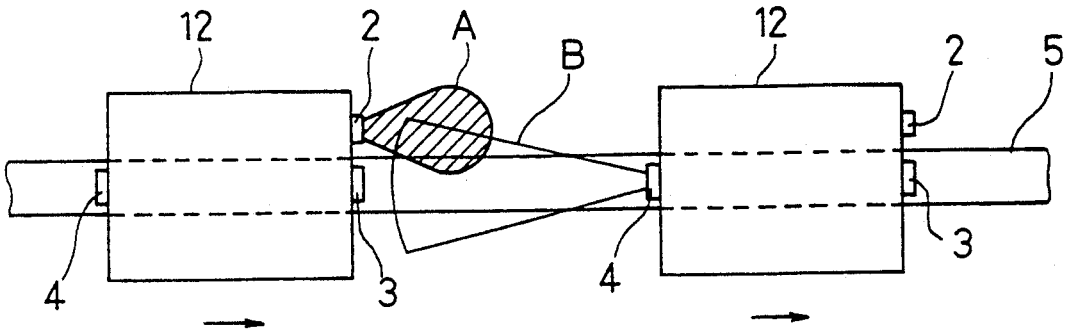
FIG. 8 shows the light projection characteristic of the self-propelled truck described in FIGS. 6 and 7.

FIGS. 6 through 8 are views explanatory of the third embodiment of the invention.

FIG. 8 shows two self-propelled trucks 12 travelling on the travel rail 5, each of which has a photoelectric switch 2 for detecting the truck travelling in advance the same as the truck shown in FIG. 1, the photoelectric switch 2 being provided at the front of truck 12 and detecting the existence of an object in a front detection area A hatched in the drawing. Also, the self-propelled truck 12 is provided at the front thereof with a photosensor receiver for detecting the light emitted from the front and at the rear with a photosensor transmitter 4 for projecting the light to a region B more remote and wider than the detection area A, the photosensors 3 and 4, the same as the photoelectric switch 2, being connected to the main body controller 17 shown in FIG. 1.

Next, explanation will be given on travel control by the main body controller 17 in accordance with the FIG. 6 flow chart.

At first, the positional address signal transmitted from the ground controller 11 is compared with the present positional address to determine whether or not the travel command is transmitted (in a step C-1). When no travel command, nothing is executed to finish working and, when the travel command exists, it is determined whether or not the photo-electric switch 2 operates (in a step C-2). When the photo-electric switch 2 does not operate, it is determined whether or not the photosensor receiver 3 operates (in a step C-3). When the photosensor receiver 3 does not operate, the truck is driven at high speed of, for example, 100 m/min (in a step C-4) and when the same operates, the speed is reduced from high speed to drive the truck at low speed of, for example, 10 m/min (in a step C-5).

In the step C-2, when the photoelectric switch 2 operates, the travel speed of truck 12 computed from the number of rotations of travel motor detected by pulse input from the encoder 23 is determined as to whether it is lower than the predetermined low speed (in a step C-6). When lower than the low speed, the truck is stopped at the predetermined reduced speed without exerting the brake (in a step C-7), which is the same as the conventional one described in FIG. 5. When the travel speed exceeds the predetermined low speed, it is determined whether the set speed between the low and high speeds is, for example, 30 m/min or less (in a step C-8). When the travel speed is lower than the set speed, the brake at the travel motor 22 is exerted to stop the truck (in a step C-9). When exceeding the set speed, an alarm signal is generated so as to be transmitted to the ground controller 11 through the main body modem 19, distributor 18, antennas 15A and 15B, feeder wire 14, and ground modem 13, thereby informing of trouble in the photo-sensor receiver 3 (in a step C-10). In the step C-9, the brake at the travel motor 22 is exerted to stop the truck 12.

Speed characteristic when the predetermined high speed is 100 m/min, the predetermined low speed 10 m/min, and the set speed 30 m/min, is shown in FIG. 7. When the travel speed is 10 m/min or less, the truck is stopped at the predetermined reduced speed the same as the conventional embodiment, when over than 10 m/min, the brake is exerted to stop the truck, and when over than 30 m/min, an alarm signal is issued.

As shown by the one-dot chain line in FIG. 7, even when the photosensor receiver 3 operates later to delay speed reduction, the brake is exerted corresponding to the travel speed during the operation of photoelectric switch 2, thereby enabling the truck 12 to be prevented from a rear-end collision with the front truck. Therefore, it is avoidable that the bumper switch 21 operates to stop the truck 12 to lead to stopping of the load transport equipment, and an improvement in working efficiency can be expected. Trouble in the photosensor receiver 3 is alarmed, maintenance, such as renewal of photosensor receiver 3 can be performed before the occurrence of a rear-end collision with the truck.

In addition, in this embodiment, the brake at the travel motor 22 is exerted, which may alternatively be a brake for locking wheels of truck 12.

FIGS. 9 through 14 show the fourth embodiment of the invention.

Figure 9:
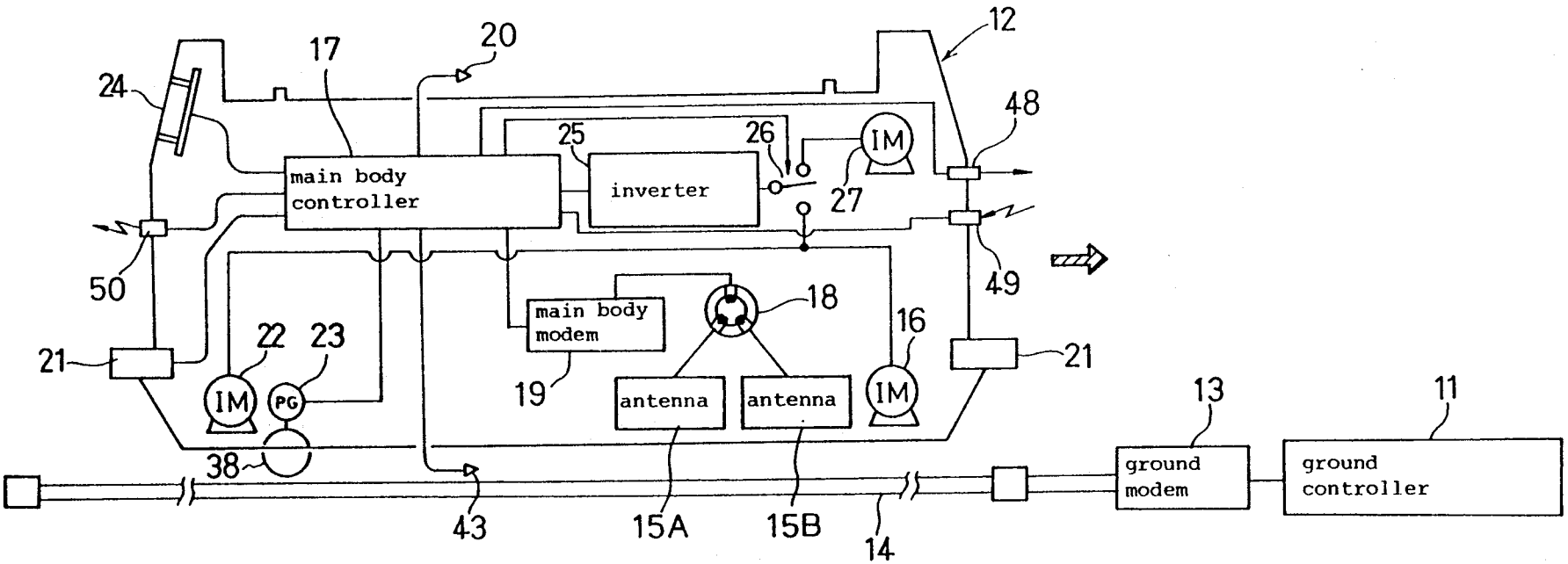
FIG. 9 is a block diagram of the self-propelled truck in a fourth embodiment of the load transport equipment of the invention.
Figure 10:
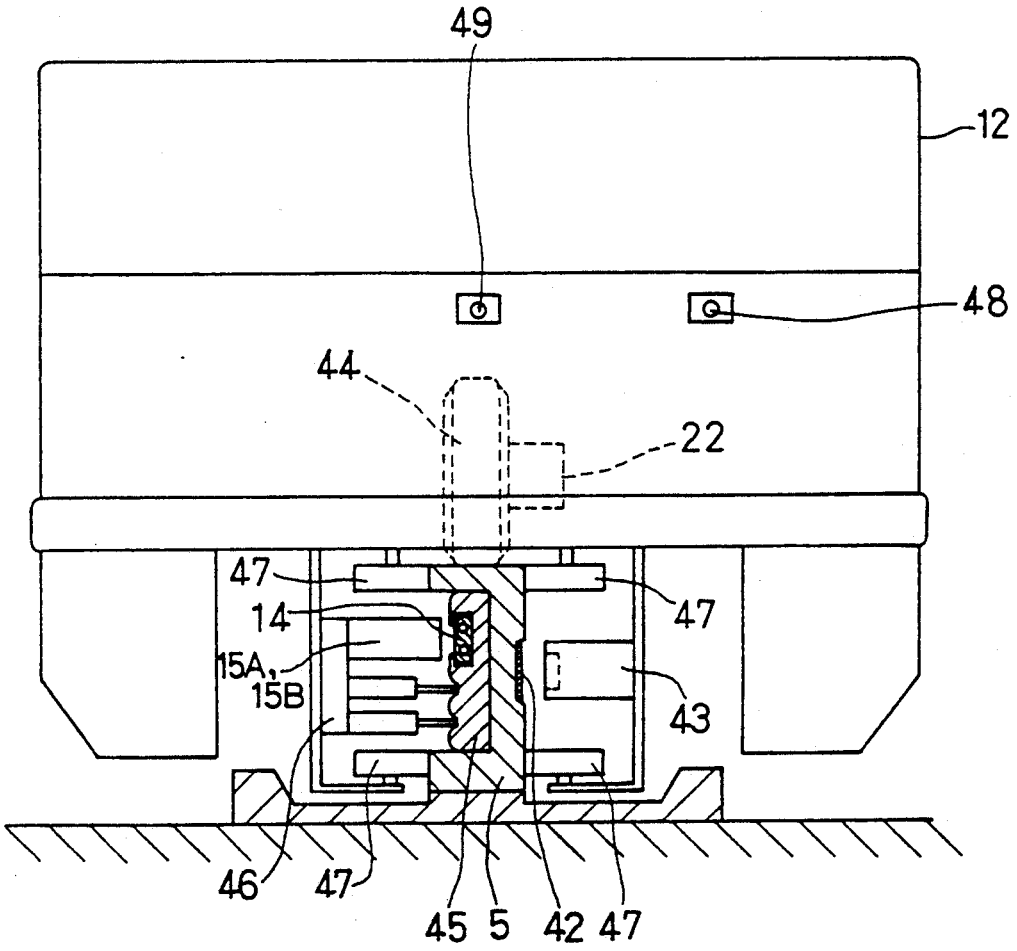
FIG. 10 shows the self-propelled truck and a rail in the load transport equipment in FIG. 9.
Figure 11:
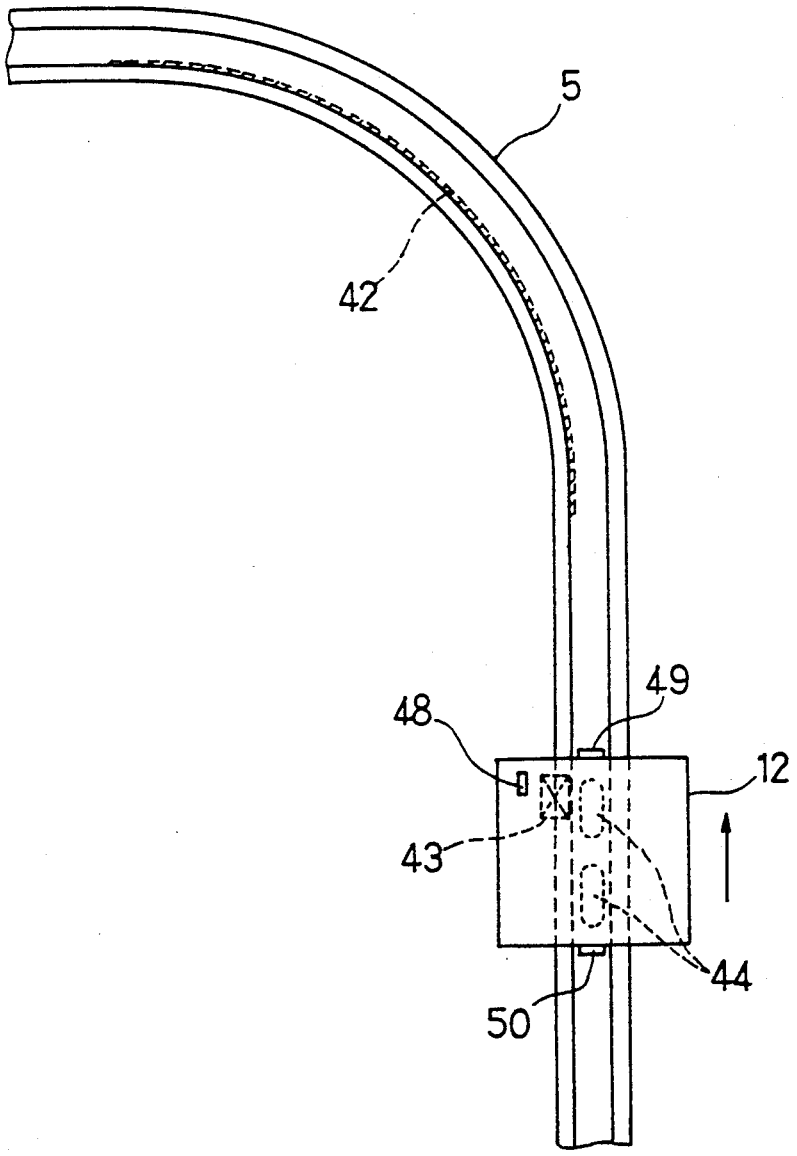
FIG. 11 is a partial plan view of the load transport equipment in FIGS. 9 and 10.

FIG. 9 shows a self-propelled truck 12 the same as that shown in FIG. 1, which has a curve detector 43, the curve detector 43, as shown in FIGS. 10 and 11, detects a curved portion by a magnet tape 42 provided at the curve portion of a travel rail 5, and furthermore the polarity of magnet tape 42 detects a leftward curve or a rightward curve, the curve detector 43, the same as the other sensors, being connected to the main body controller 17. In addition, in FIGS. 10 and 11, reference numeral 44 designates a driving wheel of the self-propelled truck 12.

In FIG. 10, reference numeral 45 designates a rail for power supply, 46 designates a collector for collecting a current from the rail 45, and 47 designates a guide roller for preventing rolling of the truck.

Next, detailed explanation will be given on a photoelectric switch 48, a photosensor receiver 49 and a photosensor transmitter 50 in this embodiment.

Figure 12:
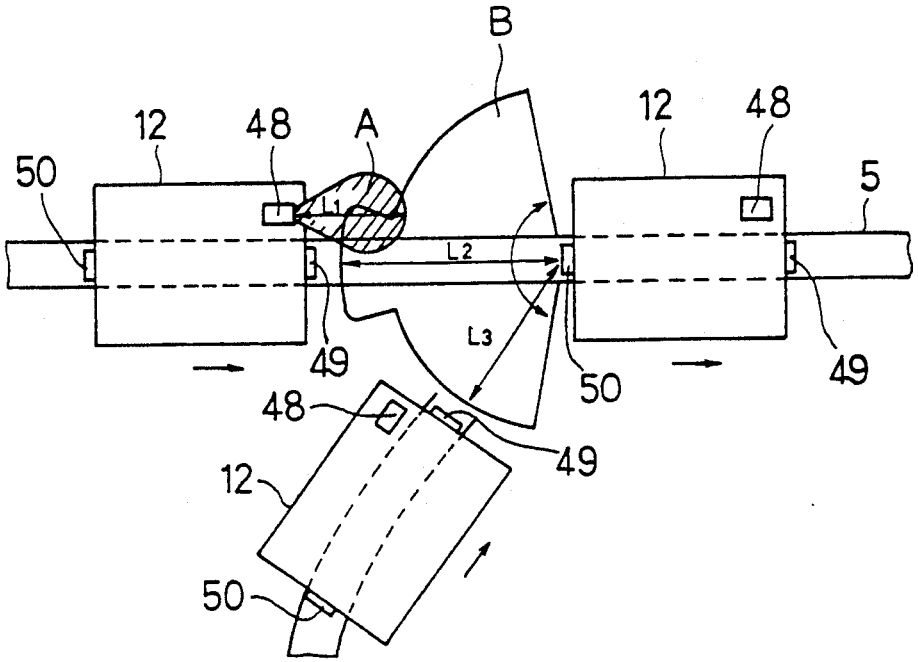
FIG. 12 shows the light projection characteristics of the self-propelled truck in the load transport equipment in FIGS. 9 to 11.
Figure 13:
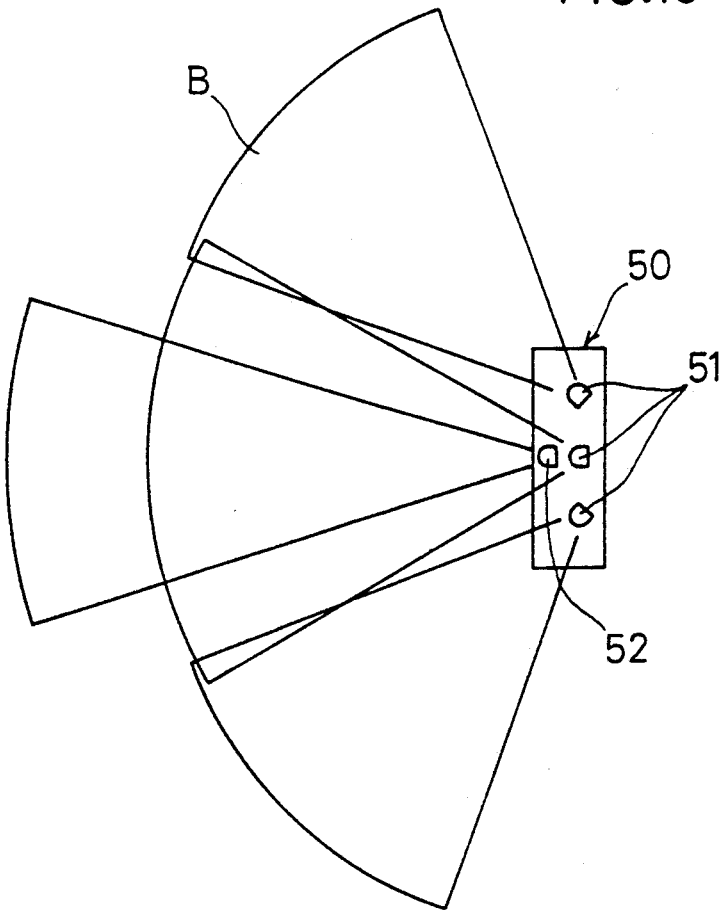
FIG. 13 is an enlarged detail view of the main portion in FIG. 12.

As shown in FIG. 10, the photoelectric switch 48 mounted at the front of the self-propelled truck 12 detects the existence of an object in a front detection area A hatched in FIG. 12, and operates when the object exists. The photosensor transmitter 50 mounted at the rear of the same, as shown in FIG. 12, projects the light rearwardly to form a fan-shaped light-projection region B having a rearwardly extended central portion, is also adjustable as to projection distance and a projection angle, and, as shown in FIG. 13, has three light emitting diodes 51 for forming the fan-shaped portion of light-projection region B and one light emitting diode 52 for projecting the central portion.

When the largest detection distance at the detection region A is represented by $L_1$, the light-projection distance at the central projecting portion at the light-projection region B by $L_2$, and the light-projection distance of the fan-shaped portion thereof by $L_3$, the light-projection area B is made larger as $L_2>L_3>L_1$ than the detection region, where $L_3>L_2>L_1$ may be made depending on the speed of truck 12 and a curvature of curved rail. The photosensor receiver 49 mounted at the front of self-propelled truck 12 is composed of a photodiode, and, when entered into the light-projection region B of photosensor transmitter 50, detects the light to operate. Since the light-projection region B is fan-shaped and projects at the central portion, as shown in FIG. 12, at the linear portion of rail 5, when a self-propelled truck 12 approaches another truck, that is, within the light projection distance $L_2$, the photosensor receiver 49 operates, and at the curved portion, when the truck 12 approaches the fan-shaped portion of light projection region B, that is, within the light projection distance $L_3$ ($L_3<L_2$), the photosensor receiver 49 operates.

Figure 14:
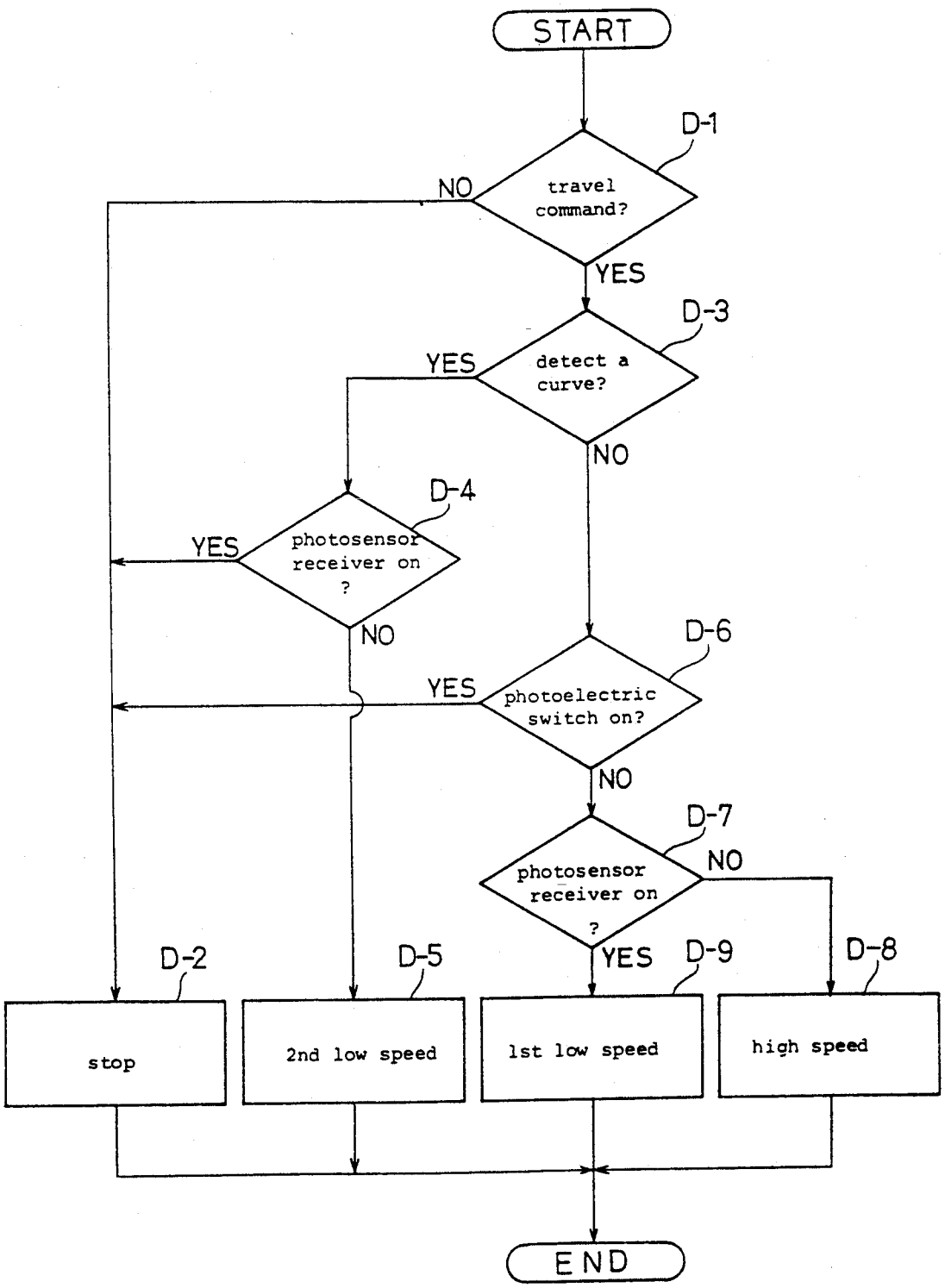
FIG. 14 is a flow chart of the travel control of the self-propelled truck used in the load transport equipment shown in FIGS. 9 to 13.

Next, explanation will be given on travel control by the main body controller 17 in accordance with the flow chart of FIG. 14. At first, the positional address signal transmitted from the ground controller 11 is compared with the address of present position to determine whether or not a travel command is transmitted (in a step D-1). When there is no travel command, the truck stops (in a step D-2), when there is travel command exists, it is determined whether or not the curve detector 43 detects the curve (in a step D-3), when the curve is detected, the command is transmitted (in a step D-1), when there is no travel command, the truck stops (in a step D-2), when travel command exists, it is determined whether or not the curve detector 43 detects the curve (in a step D-3), when the curve is detected, the photosensor receiver 49 determines whether or not it operates (in step D-4), when the photosensor receiver 49 operates, it is determined that the trucks 12 are close to each other to stop the truck at the step (D-2), and, when the same does not operate, the truck is caused to travel at a second lower speed of, for example, 40 m/min, as the curved portion speed (in a step D-5).

When the curve is not detected in the step (D-3), that is, at the linear line, it is determined whether or not the photoelectric switch operates (in a step (D-6)), so that, when it operates, the truck stops in the step D-2, and when not so, it is determined whether or not the photosensor receiver 49 operates (in a step D-7). When the photosensor receiver 49 does not operate, the truck is driven at the speed of, for example, 100 m/min (in a step D-8), and, when it operates, high speed is cut to drive the truck at a first low speed of, for example, 40 m/min (in a step D-9).

Such travel control is carried out, so that the self-propelled truck 12, at the straight portion, detects the extended central portion rather than the curved portion at the light-projection region B, thereby reducing the speed to stop by operation of photoelectric switch 18. At the curved portion, the curve detector 43 detects the curve to thereby reduce the speed, and the photosensor receiver 19 detects the fan-shaped portion smaller in light-projection distance than the linear portion at the light-projection region B, thereby stopping the truck.

Hence, the travel speed at the linear portion is changed in two stages, whereby the speed, when two trucks are not close to each other, can be made high. Also, since it is possible to reduce a distance between the adjacent two trucks regardless of a zone, a cycle time is reducible. Also, since the zone is not controlled, the ground controller 11 can be of simplified control. Furthermore, the light projection distances $L_2$ and $L_3$ of photosensor transmitter 50 are adjustable, whereby a close distance between the trucks when they slow down or stop can be maintained, thereby preventing rear-end collision with the truck travelling at the speed required therefor.

Figure 15:
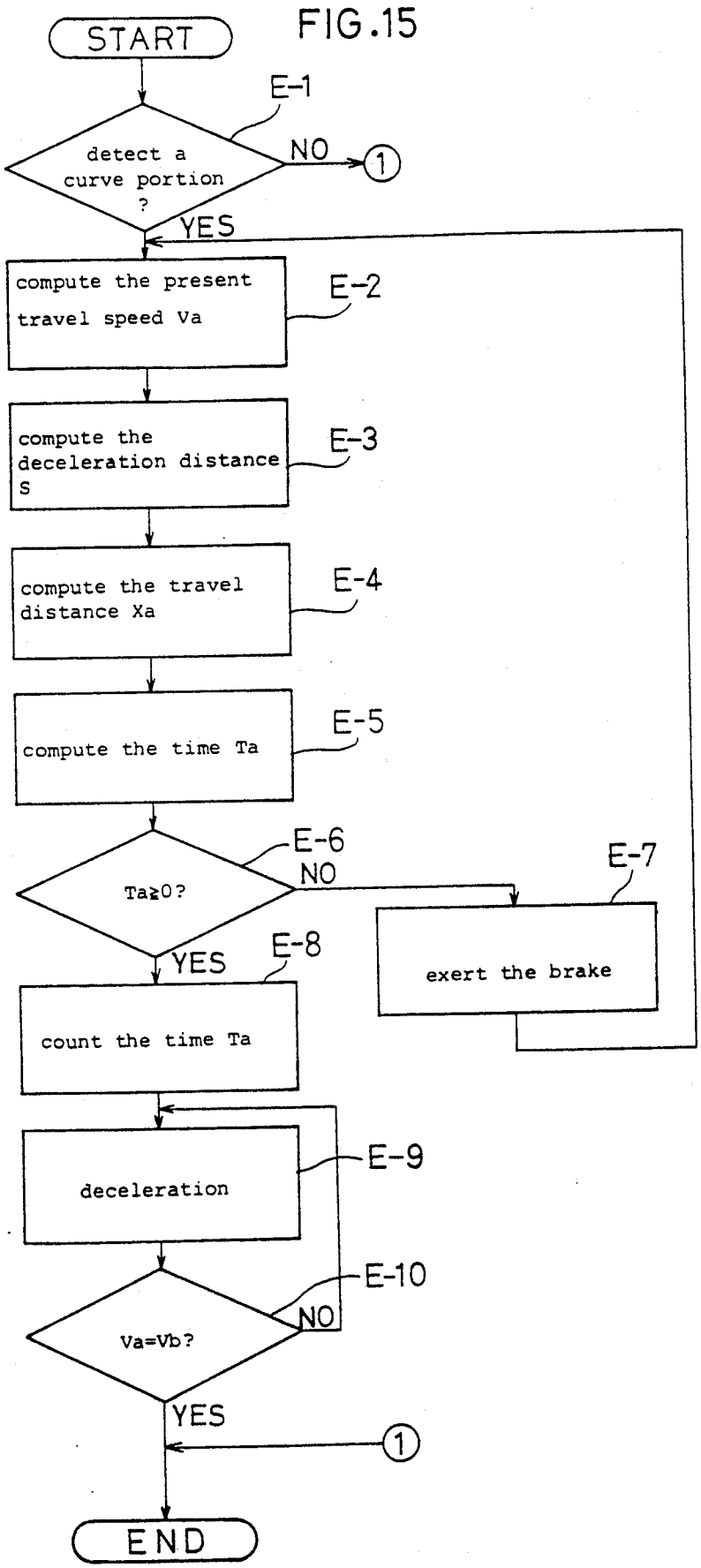
FIG. 15 is a flow chart of the travel control of the self-propelled truck in a fifth embodiment of the load transport equipment of the invention.
Figure 16:
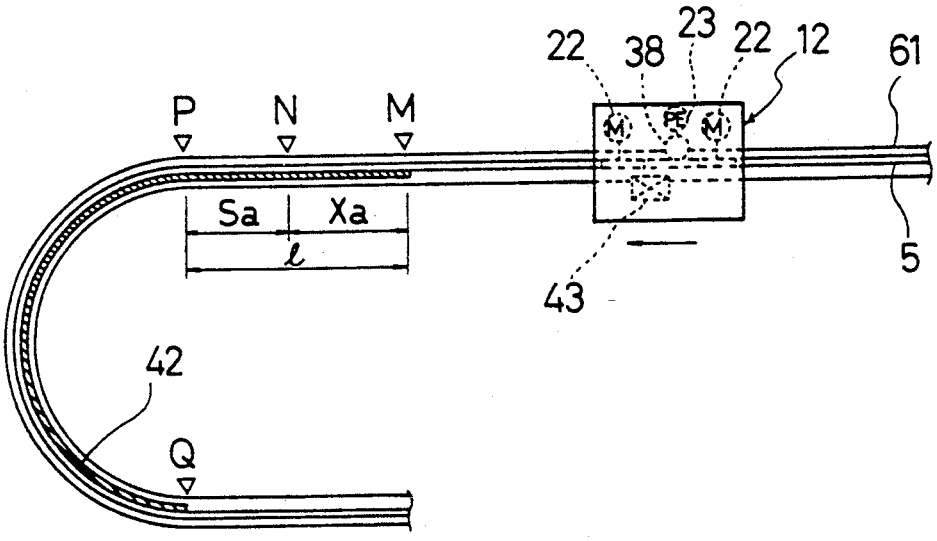
FIG. 16 is a partial plan view of the load transport equipment shown in FIG. 15.
Figure 17:
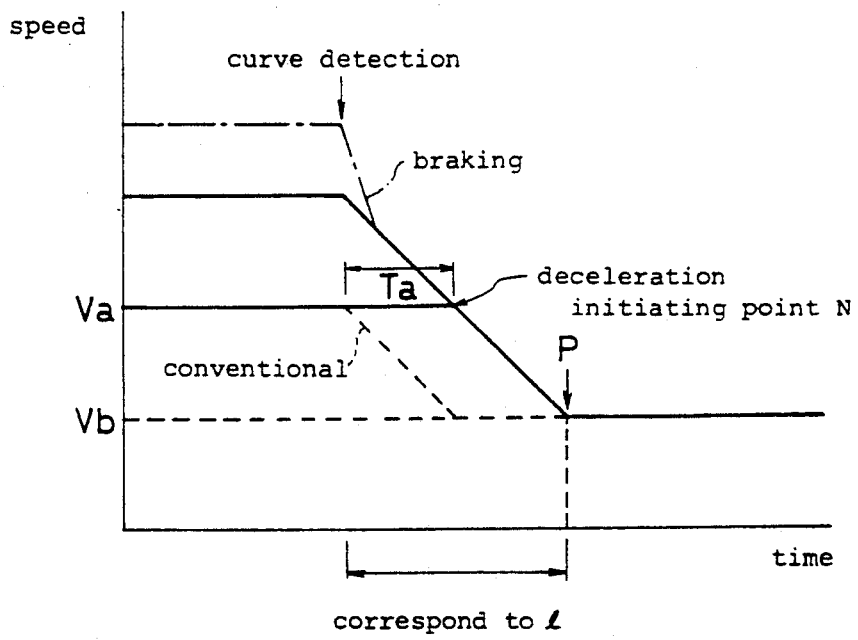
FIG. 17 shows the travel characteristics of the self-propelled truck shown in FIGS. 15 and 16.

FIGS. 15 through 17 show the fifth embodiment of the invention.

In FIG. 16, reference numeral 5 designates a travel rail, which is supported by a leg frame 61 and constructed to have a curved portion the same as FIG. 11. A magnet tape 42 is continuously stuck to the rail 5 at the curved portion thereof and at a predetermined distance l before the curved portion.

Now, it is assumed that a self-propelled truck 12 the same as that shown in FIG. 9 is running from the linear portion to the curved portion of rail 5. The predetermined speed of truck 12 at the curved portion of rail 5 (to be hereinafter called the curve speed) is represented by $V_b$, the present travel speed by $V_a$, the predetermined degree of deceleration of truck 12 by a, a distance between the spot M where the magnet tape 42 shown in FIG. 16 is initiated to be stuck to the rail 5 before the curved portion and the spot N where the deceleration is initiated (to be hereinafter called the travel distance), by $X_a$, and a distance between the spot N and a curve beginning spot P (to be hereinafter called the "deceleration distance") by $S_a$.

In FIG. 15, at first, the curve detector 43 detects magnetism of magnet tape 42 indicating that the truck approaches the travel rail 5 (in a step E-1) and the counted value input from a counter 6 is used to compute the present travel speed $V_a$ (in a step E-2).

Next, from the computed present travel speed $V_a$, curve speed $V_b$ and deceleration a, the deceleration distance $S_a$ is computed. Then, the deceleration distance $S_a$ is given in the following expression (in a step E-3):

$$S_a = \frac{V_a^2 - V_b^2}{2a} \tag{11}$$

The travel distance is computed by use of the following expression (in a step E-4):

$$X_a = l - S_a \tag{12}$$

A time a to reach the deceleration spot N is computed from the travel distance X by use of the following expression (in a step E-5):

$$T_a = \frac{X_a}{V_a} \tag{13}$$

Next, the time $T_a$ is checked as to whether it is positive (in a step E-6), when the time $T_a$ is negative, the brake of travel motor 22 is exerted (in a step E-7), and the travel speed $V_a$ is reduced to return to the step (E-2) to wait for the time $T_a$ to be positive.

In the step E-6, when the time $T_a$ is positive and the brake of travel motor 22 is exerted, the brake is released and the time $T_a$ is counted (in a step E-8). When the time $T_a$ is counted, in other words, when the self-propelled truck 12 reaches the deceleration spot N, the speed is reduced at the degree of deceleration a, and the travel speed $V_a$, when it becomes the curve speed $V_b$, transfers to constant speed (the curved speed $V_b$) (in steps E-9 and E-10).

An example of speed pattern by the deceleration control of the truck 12 is shown in FIG. 17.

As shown in FIG. 17, the truck 12 changes the speed firstly at the curve beginning spot P from the present travel speed $V_a$ to the curved speed $V_b$, but not to the low curve speed $V_b$ before the curve beginning spot P. Therefore, the transportation time is reducible and the transportation capacity is improvable.

When the curve detector 43 such as a magnetic sensor begins to not detect the magnetism of the magnet tape 42, that is the truck 12 reaches to a curve ending spot Q, the truck 12 accelerates and shifts to the high speed travelling for the straight portion.

According to the embodiment, as the magnet tape 42 is continuously disposed from the spot M where the truck 12 enters to the curve ending spot Q, even if the power source changes into "OFF" while the truck 12 is travelling the curved portion, it is detected that the truck is positioned at the curved portion when the power source is recovered. Therefore, the truck can re-start at the curve speed $V_{b1}$ thereby preventing dropping of the load and derailing of the truck. Furthermore, when the truck 12 is not positioned at the curved portion, the truck can re-start at the travel speed $V_a$ higher than the curve speed, thereby enabling the transportation time to be reduced.

Though the magnet tape 42 is attached continuously from the curve starting spot M to the curve ending spot Q in this embodiment, it is possible to detect the curve starding spot M and the curve ending spot Q by attaching the magnet tape to those spots M and Q only.

In this embodiment, the magnet tape 42 is utilized to detect the curved position, whereas other means, such as a miller, may alternatively be utilized. By using a reflection type photoelectric switch which is faced to the miller, the curved portion can be detected.

Figure 18:
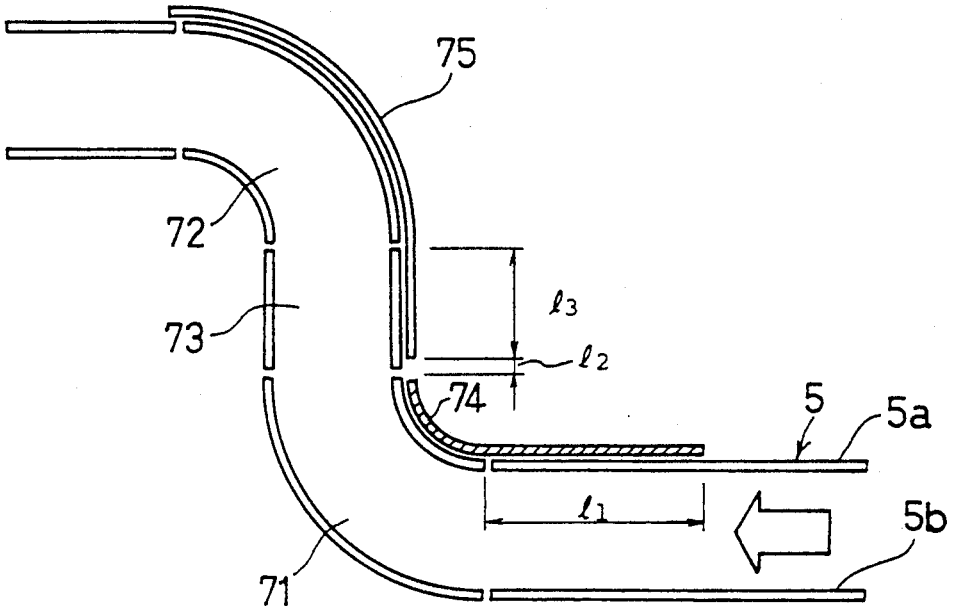
FIG. 18 is a partial plan view of a sixth embodiment of the load transport equipment of the invention.
Figure 19:
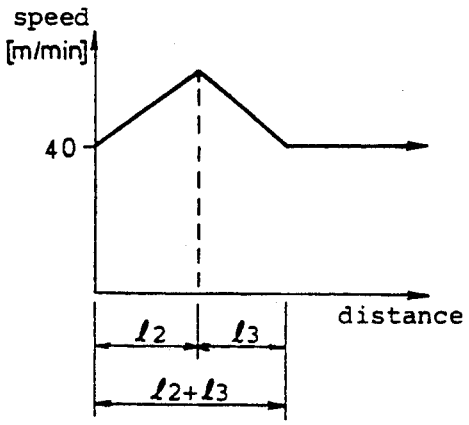
FIGS. 19 and 20 show the travel characteristics of the self-propelled truck of the load transport equipment in FIG. 18.
Figure 20:
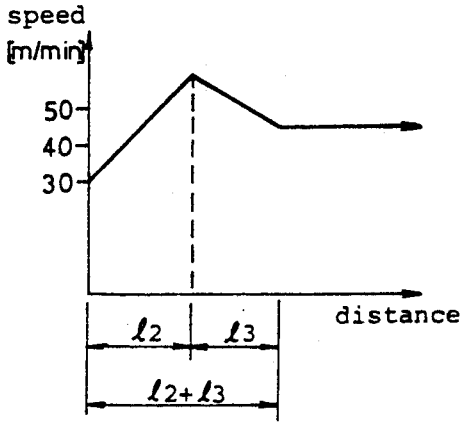

FIGS. 18 through 20 show the sixth embodiment of the present invention.

The embodiment in FIGS. 15 to 17 shows a single curved portion, but the sixth embodiment in FIGS. 18 to 20 shows a plurality of curved portions spaced at a certain distance.

In FIG. 18, the travel rail 5 comprises a pair of rails 5*a* and 5*b* and has a rightward curved portion 71 and a leftward curved portion 72 in continuation thereof, both the curved portions 71 and 72 being provided therebetween with a linear portion 73 of a predetermined length. To the rightward curved portion 71 of one rail 5*a* is stuck a rightward curved magnet tape 74 and to the leftward curved portion, a leftward curved magnetic tape 75, both magnet tapes 74 and 75 being distinguished from each other by a chang of polarity and being stuck onto the rails from the curved portions to the linear portions in front thereof. $l_1$ is a length at the front of the curve beginning spot and the truck is reducible in speed down to the "curve speed" within a range of $l_1$. Similarly, $l_3$ is a length of the portion where the speed of truck is reduced to the curve speed in front of the curve beginning spot at the leftward curved portion 72. A portion of length $l_2$ is put at the linear portion 73 between the curve end spot and the beginning end of $l_3$. For example, the truck travelling before the rightward curved portion 71 at the speed of 100 m/min reduces the speed to the curved speed of 40 m/min within the range of $l_1$ and travels along the rightward curved portion 71, the speed described herein means the speed of the truck on the longitudinal center line of the truck, in other words, on the center line between the rails 5*a* and 5*b*.

There is the linear portion 73 between the rightward curved portion 71 and the leftward curved portion 72. If the truck travels at the curved speed also on the linear portion 73, it takes too much time. Hence, acceleration occurs as shown in FIG. 19 in a range of length $l_2$ before the portion of $l_3$ for deceleration. As the result, at the portion of magnet tape 75, that is, the beginning spot of length $l_3$, the speed of the truck is higher than the curved speed (40 m/min), so as to decelerate again to the curved speed in the range of $l_3$ and to drive the truck at the curved speed to the leftward curved portion 72. Thus, the travelling time from the end of rightward curved portion 71 to the beginning end of leftward curved portion 72 is reduced, thereby improving the transportation capacity.

As the above-mentioned, FIG. 19 shows the speed of truck on the center line thereof. For reference, the travel speed of the driving wheel at the self-propelled truck on the rail 5*a* is shown in FIG. 20.

FIGS. 21 through 25 show the seventh embodiment of the invention.

Figure 21:
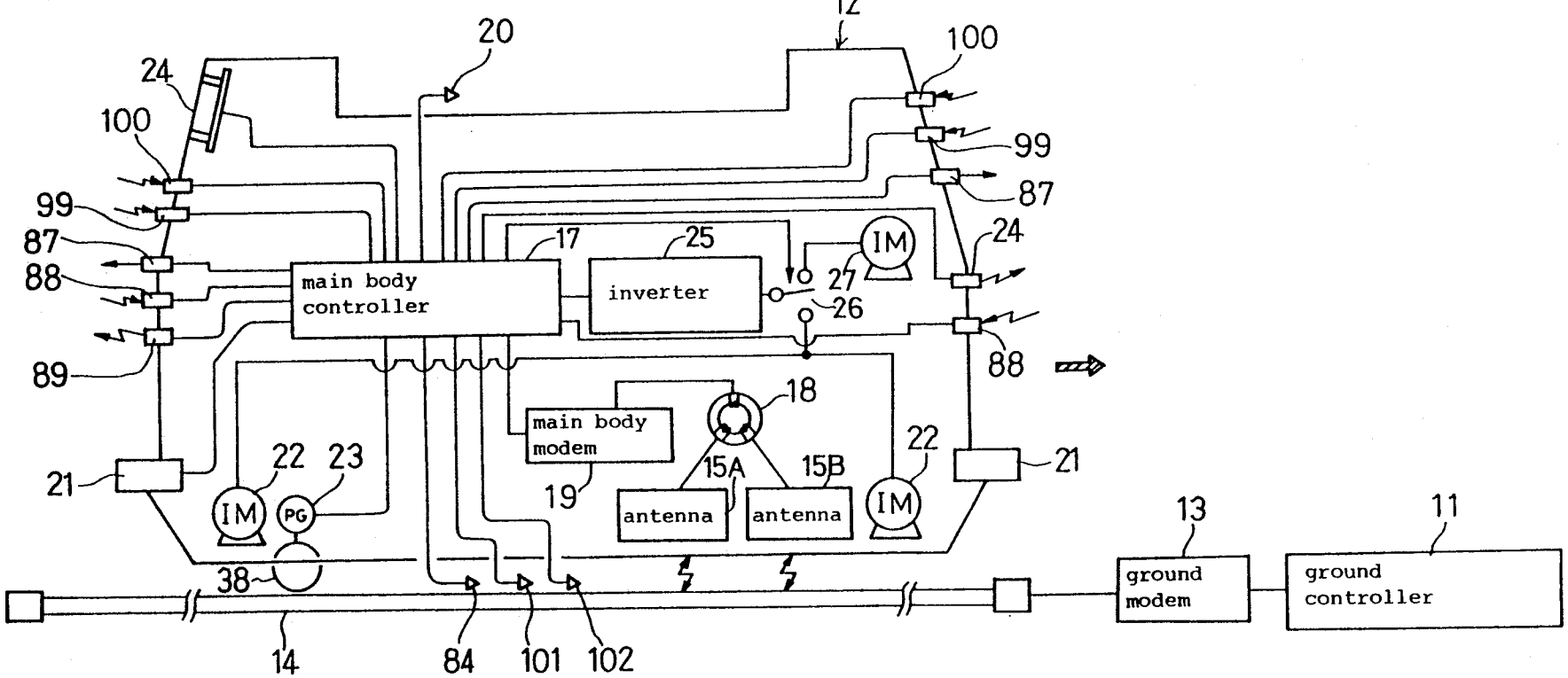
FIG. 21 is a block diagram of the self-propelled truck in a seventh embodiment of the load transport equipment of the invention.
Figure 22:
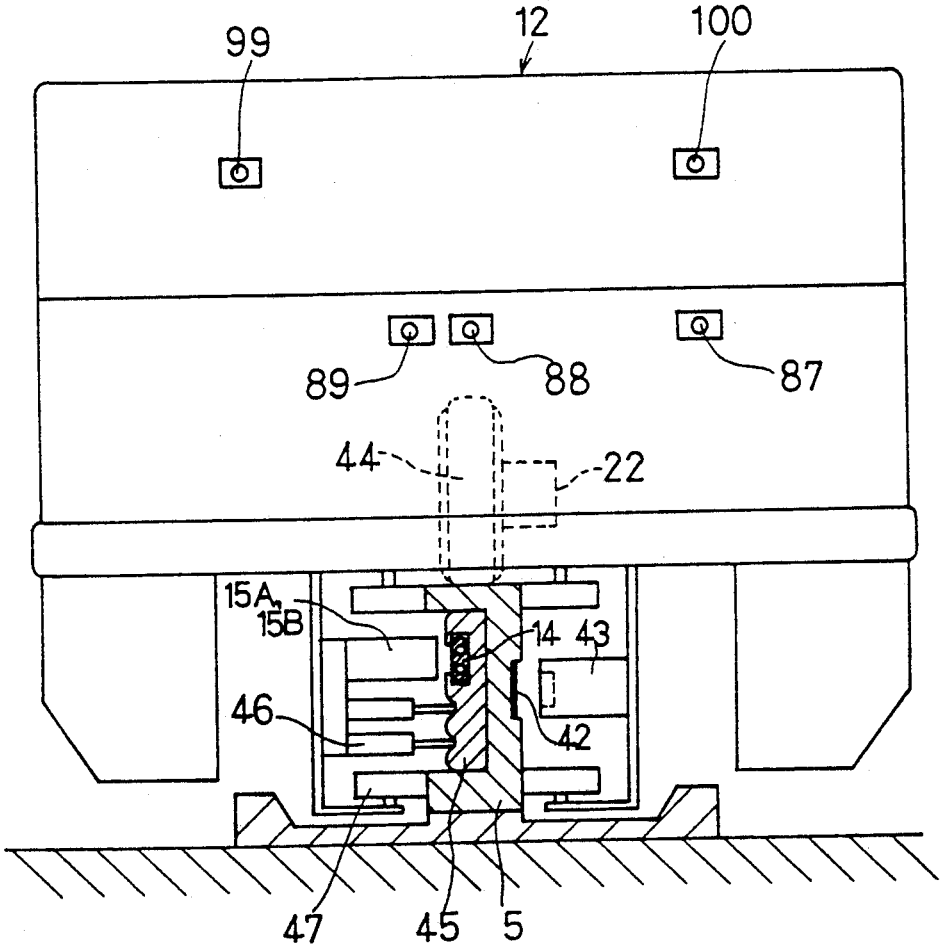
FIG. 22 shows the self-propelled truck and a rail in the load transport equipment in FIG. 21.
Figure 23:
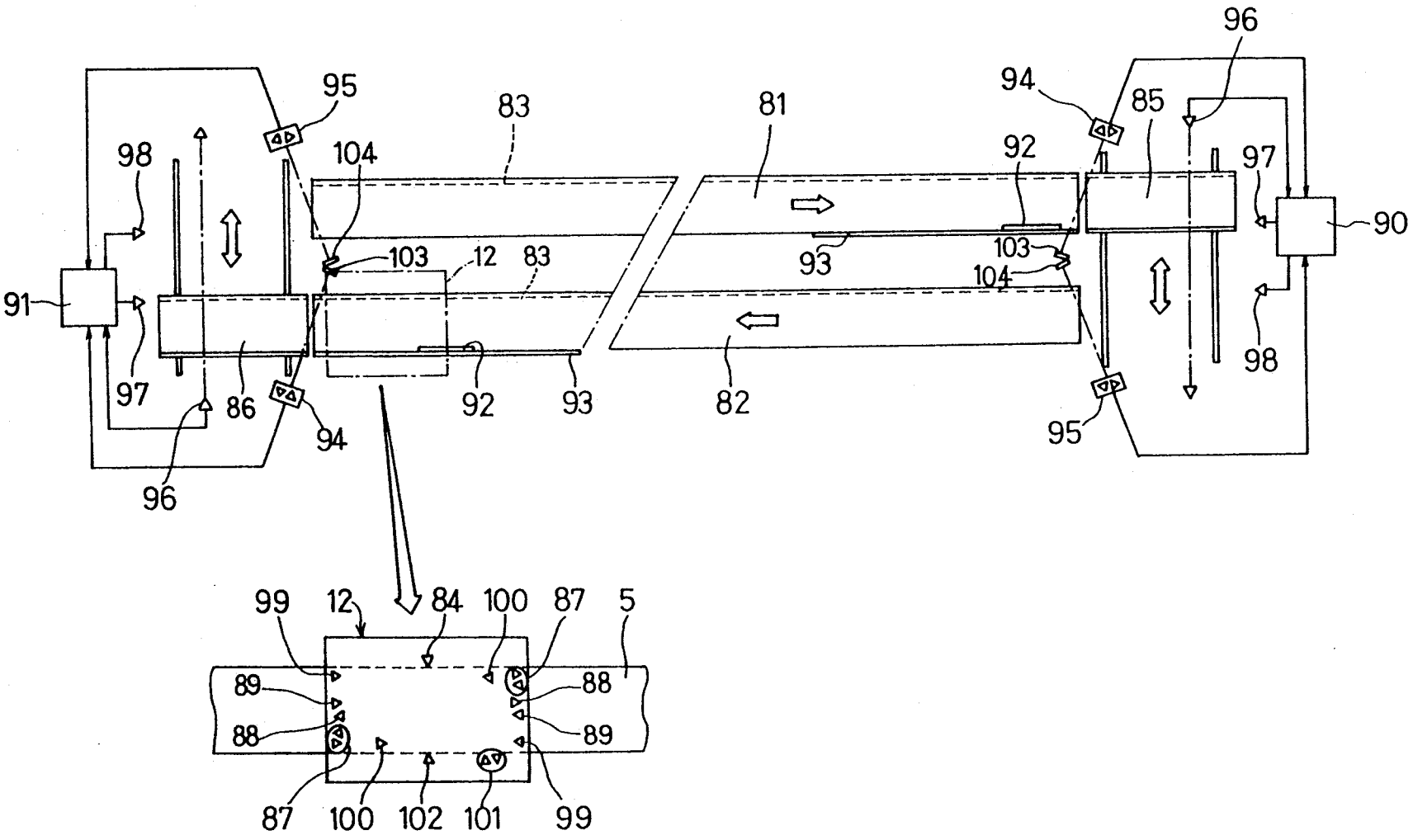
FIG. 23 is a plan view of the load transport equipment shown in FIGS. 21 and 22.

As shown in FIG. 23, this embodiment is so constructed that the self-propelled truck 12 travels along a pair of travel rails 81 and 82 close to each other. Magnet tapes 83 are stuck onto the same sides of rails 81 and 82 respectively, one of which tapes is N-pole and the other S-pole. As shown in FIGS. 21 to 23, the truck 12 is provided with a travel direction detector 84 comprising a magnetic sensor which detects the travel direction by the polarity of magnet tape 83.

As shown in FIG. 23, at both ends of rails 81 and 82 are installed traversers 85 and 86 each moving the truck 12 in parallel from one travel rail to the other, whereby the truck 12 moves forward on one rail and rearward on the other. At the front of the self-propelled truck 12 are provided a photoelectric switch 87 and a photosensor receiver 88 for detecting another truck in advance, and at the rear of the same is provided a light transmitter 89 for projecting the light to the rear truck 12, these sensors being connected to a main body controller 17. In addition, in FIG. 23, reference numerals 90 and 91 designate control units for the traversers 85 and 86 respectively.

Next, explanation will be given on the construction and use of the traversers 85 and 86 to move the truck 12 between the travel rails 81 and 82.

As shown in FIG. 23, a reflecting plate 92 indicating a zone before the traverser is mounted to the side of each travel rail 81 or 82 in a position before each traverser 85 or 86. At the sides of traversers 85 and 86 and of travel rails 81 and 82 are stuck N-pole magnet tapes 93 respectively. A first photoelectric switch 94 is provided for detecting the existence of truck 12 traversing the travel rail 81 or 82 at the side of loading the truck onto each traverser 85 or 86. A speed photoelectric switch 95 is provided for detecting the existence of truck 12 traversing the travel rail 81 or 82 at the side of unloading the truck 12 and the traverser 85 or 86. Furthermore, third photoelectric switches each for detecting the existence of truck 12 on each traverser 85 or 86 are provided, the photoelectric switches 94, 95 and 96 being connected to the traverser control units 90 and 91 respectively.

The traverser control units 90 and 91 are connected with first optical transmitters 97 each for transmitting to the truck 12 a signal to permit admission thereof into the traverser 85 or 86 and with second optical transmitters 98 each for transmitting to the truck 12 a signal to permit discharge thereof from the traverser 85 or 86. The self-propelled truck 12 is provided at the front and rear with first and second optical receivers 99 and 100 which are connected to the main body controller 17 respectively.

Furthermore, the self-propelled truck 12 is provided with a fifth photoelectric switch 101 for detecting the reflecting plate 92 mounted on the travel rail 81 or 82 and with a high speed cut detector 102 comprising a magnetic sensor for detecting the magnet tape 93 of N-pole. In FIG. 23, reference numerals 103 and 104 designate reflecting plates for the photoelectric switches respectively.

The control method for the truck 12 by the main body controller 17, when the traversers 85 and 86 are used, will be explained in accordance with the flow chart in FIG. 24.

At first, the travelling direction of truck 12 is determined by the polarity of magnetic tape 83 detected by the travelling direction detector 84 (in a step G-1). When of N-pole, the rightward direction (forward movement) is determined to set a flag F to 1 (in a step G-2), and when of S-pole, the leftward direction (rearward movement) is determined to set the flag F to 0 (in a step G-3). Next, the ground controller 11 instructs the destination of a load and it is determined whether or not the truck is given a travel command (in a step G-4). When not given the travel command, the same stops (in a step G-5). When given, it is confirmed whether or not the truck is given the discharge authorized signal from the traverser control unit 90 or 91 through the second photo receiver 100 (in a step G-6). When not given the signal, a high speed cut detector 102 confirms whether or not the truck enters in the high speed cut zone (zone of mounting the magnet tape 93) (in a step G-7), so that when the truck is not in the zone, a high speed travel command is input to an inverter 25 in accordance with the flag F to perform high speed running (in steps G-8, G-9, G-10).

When in the step G-7 it is confirmed that the truck enters in the high speed cut zone, the fifth photoelectric switch 101 confirms whether or not the truck enters into the zone (reflecting plate 92) before the traverser (in a step G-11). When in the zone, it is confirmed whether or not an entrance authorized signal is given from the traverser control unit 90 or 91 through the first optical receiver 99 (in a step G-12), and when not given it, the truck is stopped in the step G-5. When the truck is given the entrance authorized signal or does not enter in the zone before the traverser in the step G-11, a rightward or leftward low speed travel command is input to the inverter 25 in accordance with the flag F, thereby performing low speed travel (in steps G-13, G-14, G-15).

When the discharge authorized signal is given in the step G-6, the flag F is inverted (in steps G-16, G-17, G-18), so that a low speed (discharge) travel command in the inversion direction is input to the inverter 25 in accordance with the inverter flag F, thereby performing low speed running (in steps G-19, G-20).

Figure 25:
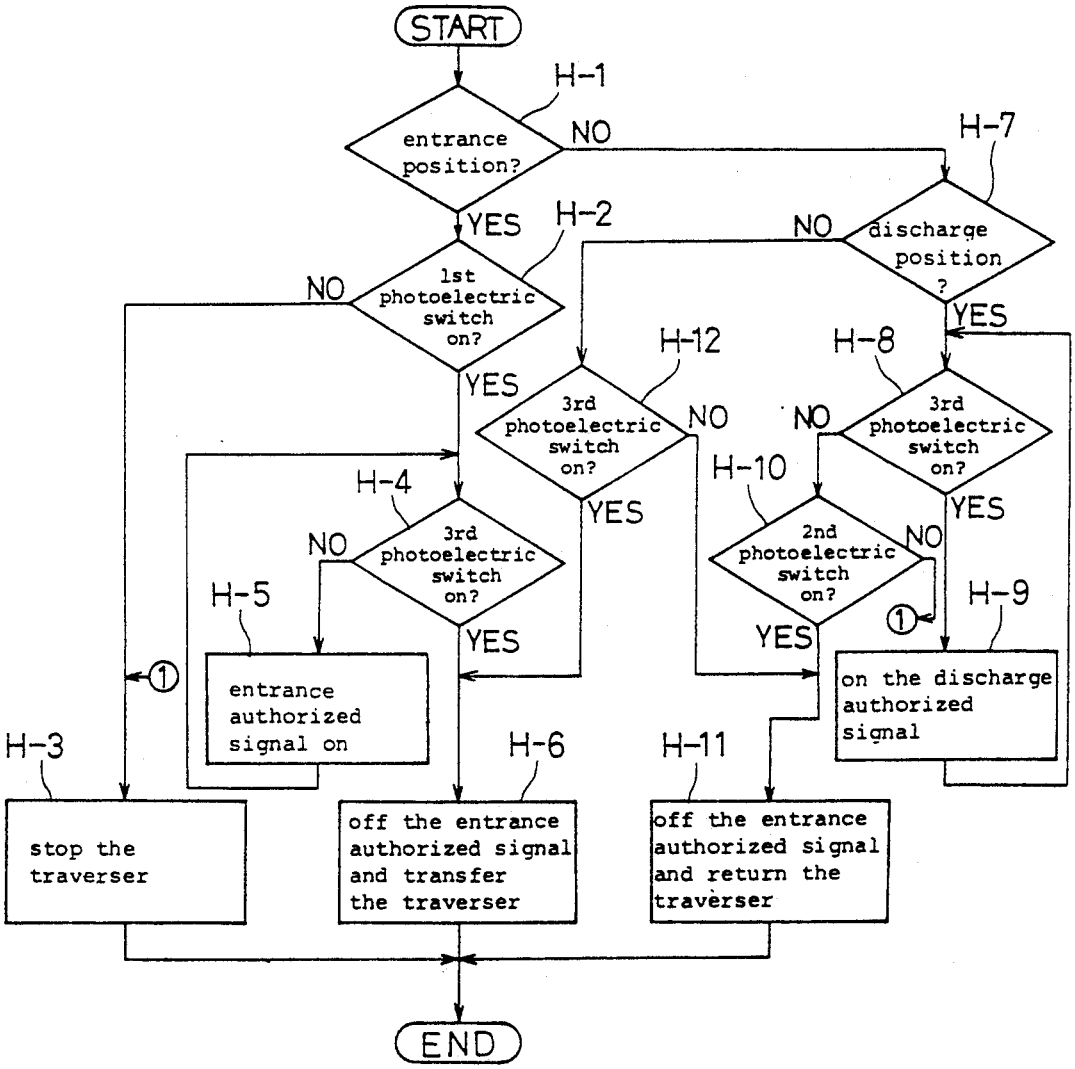
FIG. 25 is a flow chart for controlling a traverser in the load transporting equipment shown in FIGS. 21 to 23.

Next, explanation will be given on a control method for the traverser control units 90 and 91 in accordance with the flow chart in FIG. 25.

At first, it is confirmed by, for example, a limit switch whether the traverser 85 or 86 is put in the entrance position (basic position) (in a step H-1). When put in the entrance position, the first photoelectric switch 94 confirms the existence of truck 12 (in a step H-2), and, when the truck 12 is not confirmed, the traverser 85 or 86 stops (in a step H-3). When the truck 12 is confirmed in the step H-2, the third photoelectric switch 96 confirms whether or not the truck 12 is on the traverser 85 or 86 (in a step H-4). When the truck 12 is not put on the traverser 85 or 86, the first optical transmitter 97 issues the entrance authorized signal to the truck 12 (in a step H-5). When the truck 12 enters into the traverser 85 or 86 and the third photoelectric switch 96 is on, the entrance authorized signal is off to output a transfer signal to the traverser 85 or 86, so that the traverser 85 or 86 moves from the entrance position to the discharge position (in a step H-6).

When the traverser 85 or 86 is not put in the entrance position in the step H-1, it is confirmed whether or not the traverser 85 or 86 nextly is put in the discharge position (transfer position) (in a step H-7). When put in the discharge position, the third photoelectric switch 96 confirms whether or not the truck 12 is put on the traverser 85 or 86 (in a step H-8). When the truck 12 is put thereon, the second photo transmitter 98 issues the discharge authorized signal to the truck 12 (in a step H-9). When the truck 12 leaves the truck 12 and the third photoelectric switch 96 is off, the second photoelectric switch 95 confirms whether or not the truck 12 leaves from the traverser 85 or 86 (in a step H-10).

When the discharge is confirmed, the discharge authorized signal is off and a return command signal to return the traverser 85 or 86 from the discharge position to the entrance position is output, the traverser 85 or 86 returns to the original entrance position (in a step H-11). When the discharge of truck 12 is not confirmed in the step H-10, the truck 12 is kept stopped. When not put in the discharge position in the step H-7, the third photoelectric switch 96 confirms whether or not the truck 12 exists on the traverser 85 or 86 (in a step H-12), thereby continuing movement of traverser 85 or 86 (in steps H-6, H-11).

Thus, the truck 12 and traverser control units 90 and 91 are controlled, so that the truck 12 when in the vicinity of traverser 85 or 86, changes the speed from high to low, and, when the zone before the traverser is detected, stops at the position where the zone is detected until the entrance authorized signal is input. The traverser control units 90 and 91, when the first photoelectric switch 94 confirms the existance of truck 12, confirms that the traverser 85 or 86 is put in the entrance position and the truck 12 is not put on the traverser 85 or 86, thereby issuing the entrance authorized signal to the truck 12. The truck 12, when given the entrance authorized signal, enters into the traverser 85 or 86.

The traverser control units 90 and 91, which confirm that the truck 12 exists on the traverser 85 or 86, move them from the entrance position to the discharge position, so that when the traverser 85 or 86 moves to the discharge position, the units 90 and 91 issue the discharge authorized signal to the truck 12, which, when given the discharge authorized signal, inverts its travel direction to escape from the traverser 85 or 86, thereby travelling in accordance with the travel command. When the traverser control units 90 and 91 detect that the truck 12 escapes from the traverser 85 or 86, they allow the traversers 85 and 86 to return to the initial position.

As seen from the above, since the magnet tapes 83 are stuck to the travel rails 81 and 82, the self-propelled truck 12 can continuously confirm the travel direction by the polarity of tapes 83, and, even when a power source is once off, can decide the travel direction so as to travel, the magnet tape 83 not projecting from the travel rail 5 and being superior in appearance and the most inexpensive to produce as the means for transmitting the travel direction to each truck 12.

The traversers 85 and 86, which are controlled by the traverser control units 90 and 91 depending on the on-off condition of first through third photoelectric switches 94, 95 and 96, are not controlled on the basis of the position confirmation of truck 12 by the ground controller 11 and can reduce access time.

The self-propelled truck 12, when given the entrance authorized signal from the traverser control units 90 and 91, is not required to stop before the traverser 85 or 86, thereby enabling a moving time between the travel rails 81 and 82 to be reduced and the working efficiency to be improved.

Since the first through third photoelectric switches 94, 95 and 96 can control the traversers 85 and 86, the equipment of the invention can save on the number of sensors and is inexpensive to produce.

What is claimed is:

1. Load transport equipment provided with a plurality of self-propelled trucks self-propelled along a predetermined route to transport a load, said self-propelled trucks each having, detecting means provided at the front of said self-propelled truck so as to detect the existence of an object in a predetermined region formed ahead of said self-propelled truck, receiving means provided at the front of said self-propelled truck and detecting a first signal from the front of said self-propelled truck, projecting means provided at the rear of said self-propelled truck for projecting a second signal toward a remote region far from said predetermined region at the rear of said self-propelled truck, means for detecting the travel speed of said self-propelled truck, brake means for stopping travel of said self-propelled truck, and control means which, when both said receiving means and object detecting means do not operate, drives said self-propelled truck at high speed, when said receiving means only operates, drives said self-propelled truck at low speed, when said object detecting means operates and said travel speed is lower than said low speed, reduces the speed of said self-propelled truck and stops said truck, when said travel speed exceeds said low speed, exerts said brake means to stop said self-propelled truck, and, when said travel speed exceeds the set speed set between said low speed and said high speed, outputs an alarm.

* * * * *